US007134472B2

(12) United States Patent
Bennett, III et al.

(10) Patent No.: US 7,134,472 B2
(45) Date of Patent: Nov. 14, 2006

(54) PINCH RESISTANT SECTIONAL DOOR WITH DECORATIVE COMPONENTS AND METHOD OF ATTACHMENT

(75) Inventors: Thomas B. Bennett, III, Wooster, OH (US); James A. Mast, Millersburg, OH (US); Philip L. LaVelle, Canton, OH (US)

(73) Assignee: Wayne-Dalton Corp., Mt. Hope, OH (US)

( * ) Notice: Subject to any disclaimer, the term of this patent is extended or adjusted under 35 U.S.C. 154(b) by 149 days.

(21) Appl. No.: 10/843,182

(22) Filed: May 11, 2004

(65) Prior Publication Data

US 2005/0150610 A1 Jul. 14, 2005

Related U.S. Application Data

(63) Continuation-in-part of application No. 10/757,285, filed on Jan. 14, 2004.

(51) Int. Cl.
*E05D 15/16* (2006.01)

(52) U.S. Cl. ..... 160/229.1; 160/236

(58) Field of Classification Search ..... 160/229.1, 160/201, 236, 40; 52/311.1, 311.2, 290, 52/716.7, 717.01, 211; 49/70, 383
See application file for complete search history.

(56) References Cited

U.S. PATENT DOCUMENTS

| | | | | |
|---|---|---|---|---|
| 5,598,667 | A | 2/1997 | Dykes | 52/71 |
| 5,626,176 | A | 5/1997 | Lewis, Jr. et al. | 160/201 |
| 5,630,459 | A | 5/1997 | Martin | 160/236 |
| 5,709,259 | A | 1/1998 | Lewis et al. | 160/201 |
| 5,937,587 | A | 8/1999 | Zinbarg | 52/3 |
| 5,943,803 | A * | 8/1999 | Zinbarg | 40/606.07 |
| 5,946,869 | A | 9/1999 | Zinbarg | 52/202 |
| 6,035,919 | A | 3/2000 | Zinbarg | 160/113 |
| 6,059,005 | A | 5/2000 | Zinbarg | 160/90 |
| 6,131,345 | A | 10/2000 | Pelusio | 52/204.59 |
| 6,148,896 | A | 11/2000 | Pinto et al. | 160/229.1 |
| 6,212,835 | B1 | 4/2001 | Schiedegger et al. | 52/211 |
| 6,227,278 | B1 * | 5/2001 | Forsland | 160/107 |
| 6,257,307 | B1 | 7/2001 | Tollivar | 160/368.1 |
| 6,367,204 | B1 | 4/2002 | Eichler | 52/3 |
| 6,446,695 | B1 * | 9/2002 | Forsland | 160/201 |
| 6,586,085 | B1 * | 7/2003 | Jella | 428/319.1 |
| 2002/0157294 | A1 * | 10/2002 | Stanley | 40/600 |
| 2005/0050824 | A1 * | 3/2005 | Warner, III | 52/313 |
| 2005/0055921 | A1 * | 3/2005 | Vella | 52/311.1 |
| 2005/0076591 | A1 * | 4/2005 | Koeller | 52/311.1 |

* cited by examiner

*Primary Examiner*—David Purol
(74) *Attorney, Agent, or Firm*—Renner Kenner Greive Bobak Taylor & Weber

(57) ABSTRACT

A sectional door (20) having a plurality of panels (21) joined for moving between open and closed positions of the door and having pinch resistant panel-to-panel interfaces (41), said panels having a body portion (21') spacing said interfaces, an inner surface (23) and an outer surface (22) of said body portion, and decorative components (31, 32) arranged in a patterned design upon said outer surface of said body portion, said decorative components being positioned on said panels proximate to said panel-to-panel interfaces and having portions that releasably engage said panels to provide a pinch resistant interface between decorative components on adjacent of said panels.

16 Claims, 19 Drawing Sheets

PINCH RESISTANT SECTIONAL DOOR WITH DECORATIVE COMPONENTS AND METHOD OF ATTACHMENT

CROSS-REFERENCE TO RELATED APPLICATION

This application is a continuation-in-part of U.S. patent application Ser. No. 10/757,285, filed Jan. 14, 2004.

TECHNICAL FIELD

The present invention relates generally to sectional door panels and a method of attaching decorative components thereto to maintain a pinch resistant section-to-section or panel-to-panel interface. More specifically, the present invention relates to sectional door panels and a method of attaching decorative components thereto where a plurality of decorative components are attached to the panels to form various patterns. More particularly, the present invention relates to sectional door panels and a method of attaching decorative components thereto where the decorative components are provided with pinch resistant properties and are attached in such a manner to preserve the pinch resistant characteristics of the panels.

BACKGROUND ART

Sectional doors have long been employed in both residential structures, and commercial and industrial buildings. Sectional doors save space by retracting above, rather than into, the space they enclose. Decorative components have long been attached to the panels of sectional doors to enhance their aesthetic appearance. These decorative components approximate the appearance of wood trim or molding on the surface of the panels. Such molding or wood trim was originally arranged in various patterned designs on the panels.

The decorative components that have been attached to panels of sectional doors have been made of a variety of materials. Such decorative components have been glued, screwed, nailed, clamped, or otherwise rigidly fastened to the panels. However, in recent years, panels of sectional doors have also been designed to prevent objects or a user's fingers from being caught or "pinched" between the section-to-section interfaces of the panels. These pinch resistant designs have been successful in eliminating the pinching dangers associated with the moving section-to-section interfaces during the articulation of sectional doors when opening and closing. Some pinch resistant designs employ panels with contoured edge profiles along the section-to-section interface. These edge profiles minimize the space between the panels at the section-to-section interface throughout the range of motion of the sectional door, and thus effectively obviate their tendency for pinching.

Some other pinch resistant designs employ an L-shaped shield composed of a resilient sheet material that guards the gap between the upper and lower panels of a sectional door. For example, the foot portion of the L-shaped shield is attached to the upper edge of a lower sectional door panel, and the leg portion extends upwardly across the gap between the upper and lower panels. The L-shaped shield prevents objects and a user's fingers from being caught between the upper and lower panels at the section-to-section interface. Nevertheless, some objects can still be caught between the L-shaped shield and the upper panel.

Still other pinch resistant designs employ a flexible cover panel. The flexible cover panel is attached at either of its ends to the surfaces of the upper and lower panels of a sectional door by various connectors. These connectors are adapted to hold the flexible cover panel taut when the sectional door is in either the open or closed position. The flexible cover panel prevents obstacles from being caught between the panels at the section-to-section interface by effectively covering all of the section-to-section interfaces. Ideally, the flexible cover panel must be made of a rather flexible material so it can stretch as the sectional door articulates. However, if the flexible cover panel does not possess the required flexibility, then it will bind the movement of the sectional door, and if the flexible cover panel is too flexible, then it will ultimately sag. Furthermore, in the event of a storm, the flexible cover panel must be removed to prevent it from becoming damaged.

However complex these designs have become, they do not address the dangers posed by the addition of decorative components to the panels. Like the panels, the decorative components abutting one another along the section-to-section interface of the panels also pose a pinching danger. As a result, rather than using decorative components, the aforementioned patterned designs have been shaped directly into the panels themselves. The addition of the patterned designs to the panels themselves allows the pinch resistance embodied in the panels to be maintained. Furthermore, some of these sectional door designs provide for limited alteration of the patterned designs by allowing the aforementioned shaped panels to be rearranged. However, the use of shaped panels does not permit a manufacturer, or, for that matter, a consumer to substantially alter the appearance of the sectional door from time to time by adding, subtracting, or rearranging decorative components. As a result, decorative components attached to the sectional door panels are still superior at providing such design flexibility. Therefore, there is a need for decorative components that can be arranged in various patterns on the panels without presenting an additional pinch hazard, thereby effectively maintaining the pinch resistant features embodied in the panels themselves.

DISCLOSURE OF THE INVENTION

Therefore, an object of the present invention is to provide sectional door panels and a method of attaching decorative components thereto that can be arranged in various patterns on the panels. Another object of the present invention is to provide sectional door panels and a method of attaching decorative components thereto where the decorative components do not present an additional pinch hazard. Yet another object of the present invention is to provide sectional door panels and a method of attaching decorative components thereto that allows the decorative components to maintain a pinch resistant section-to-section interface.

A further object of the present invention is to provide sectional door panels and a method of attaching decorative components thereto that does not employ adhesives to fasten the decorative components yet achieves rigid attachment to the panels. A still further object of the present invention is to provide sectional door panels and a method of attaching decorative components thereto that allows the decorative components to move relative to the panels and to each other. A further still object of the present invention is to provide sectional door panels and a method of attaching decorative components thereto that does not require excessive gaps to be maintained between the decorative components.

Still another object of the present invention is to provide sectional door panels and a method of attaching decorative components thereto that allows the ends of the decorative components to releasably engage the outer surfaces of the panels. A further object of the present invention is to provide sectional door panels and a method of attaching decorative components thereto that allows the decorative components to be temporarily released to deflect away from the outer surfaces of the panels to avoid acting as a pinch point.

Yet another object of the present invention is to provide sectional door panels and a method of attaching decorative components thereto that returns the decorative components to their original shape and/or position on the panels after displacement by an obstacle caught between the components has been removed.

Still yet another object of the present invention is to provide sectional door panels and a method of attaching decorative components thereto that allows for easy replacement of the decorative components to enable a consumer to replace damaged decorative components and/or change the appearance of the sectional door from time to time. Still another object of the present invention is to provide sectional door panels and a method of attaching decorative components thereto that allows the decorative components to be installed on the panels during manufacturing or in the field by consumers, and therefore before, during, or after installation of the panels.

In general, the present invention contemplates a sectional door having a plurality of panels joined for moving between open and closed positions of the door and having pinch resistant panel-to-panel interfaces, the panels having a body portion spacing the interfaces, an inner surface and an outer surface of the body portion, and decorative components arranged in a patterned design upon the outer surface of the body portion, the decorative components being positioned on the panels proximate to the panel-to-panel interfaces and having portions that releasably engage the panels to provide a pinch resistant interface between decorative components on adjacent of the panels.

BEST MODE FOR CARRYING OUT THE INVENTION

Figure 1:
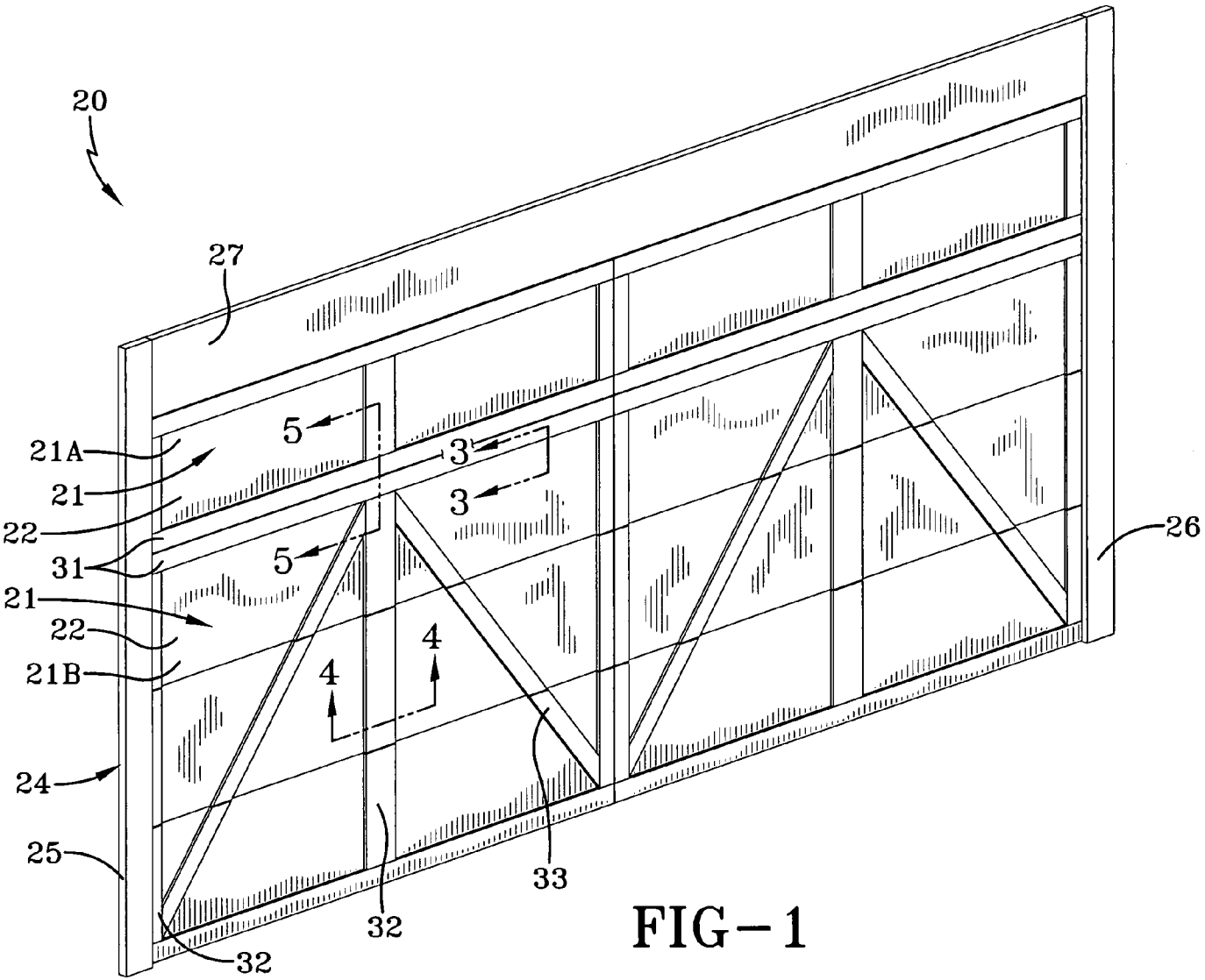
FIG. 1 is perspective view of decorative components arranged in a carriage house design.
Figure 2:
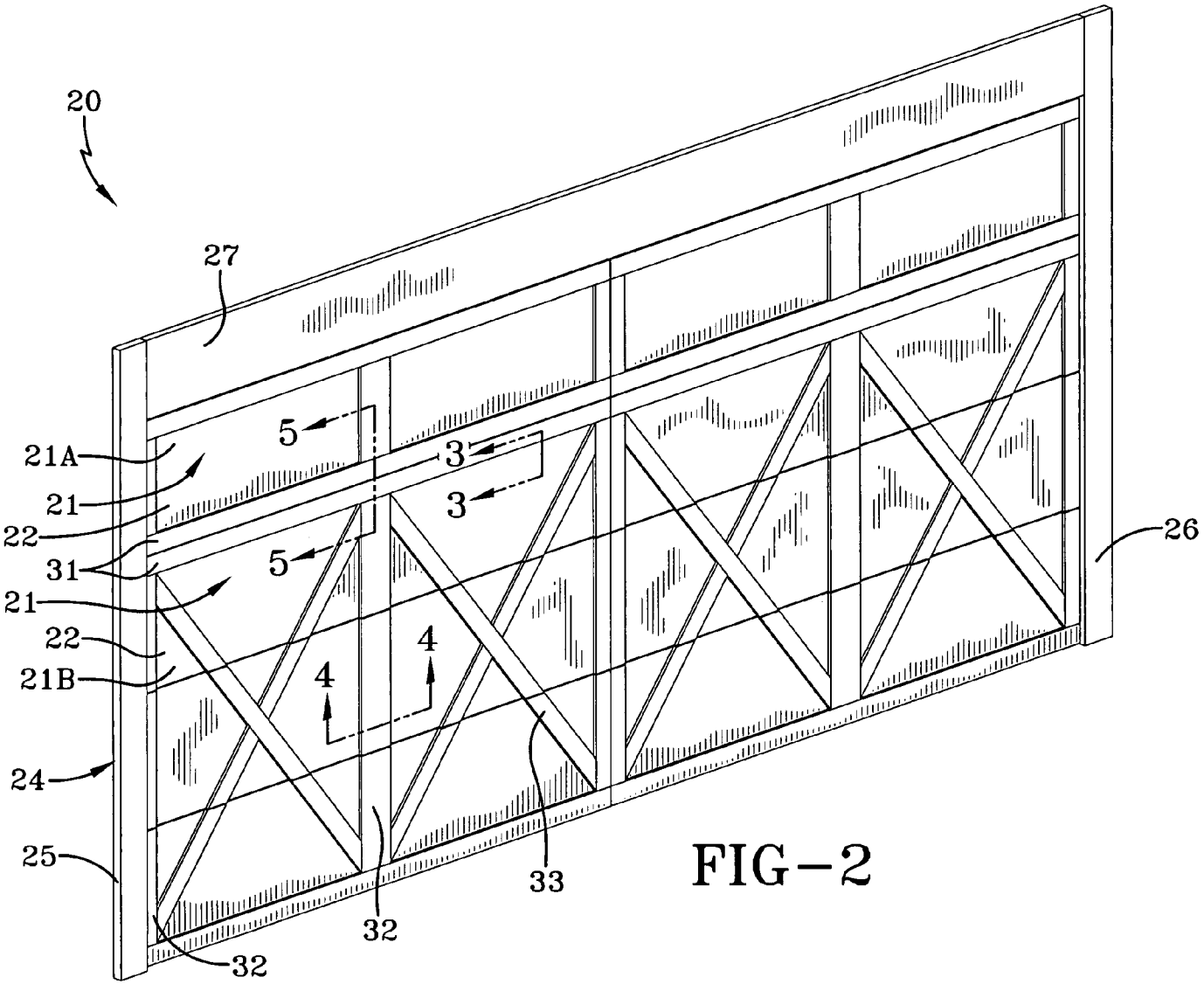
FIG. 2 is perspective view of decorative components arranged in a modified carriage house design
Figure 5:
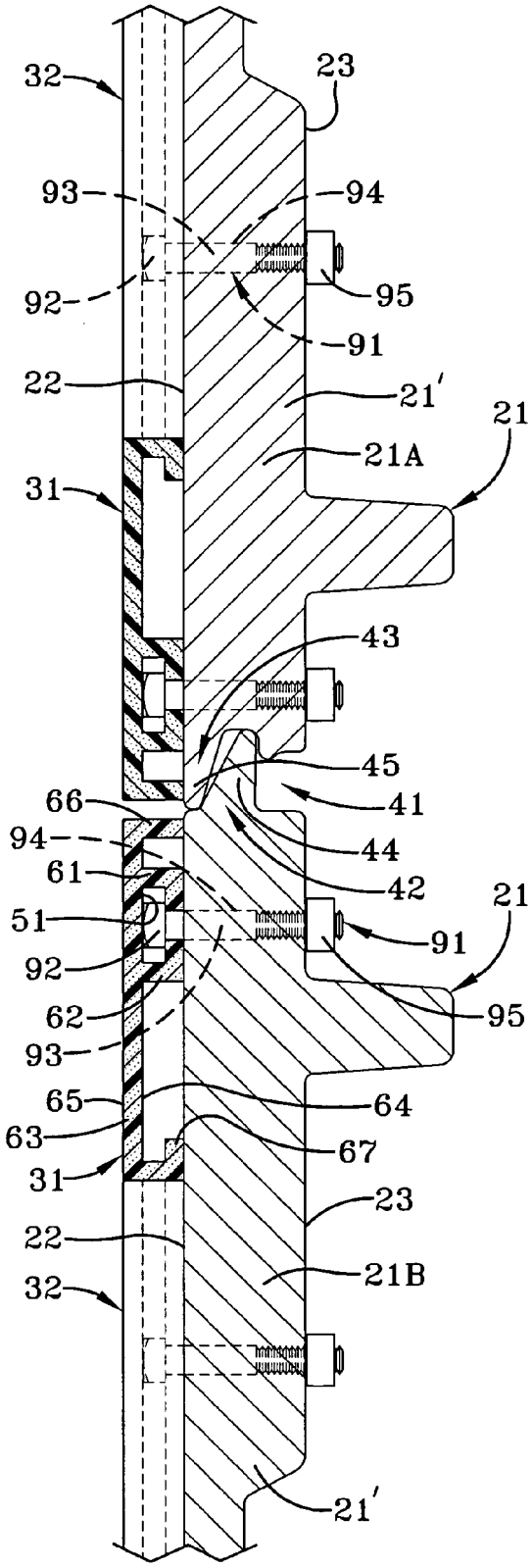
FIG. 5 is a cross-sectional view through the horizontal and vertical decorative components showing attachment to the panels taken substantially along line 5—5 of FIG. 1 or 2.

A sectional door depicting from practice of the present invention is generally indicated by the numeral 20 is FIGS. 1 and 2. The door 20 is composed of a plurality of panels 21 for articulated movement between an open and closed positions as is well known in the art. The panels have a body portion 21' with outer surfaces 22 and inner surfaces 23 (FIG. 5). Referring to FIG. 1 of the drawings, the opening in which the door 20 is positioned for opening and closing movements by articulation in conventional fashion is defined by a frame, generally indicated by the number 24, that consists of a pair of spaced jambs 25, 26 that are generally parallel and extend vertically upwardly from the floor or ground (not shown). The jambs 25, 26 are spaced and joined at their vertical upper extremity by a header 27 to thereby delineate a generally inverted U-shaped frame 24 around the opening of the door 20. The frame 24 is normally constructed of lumber, as is well known to persons skilled in the art, for the purposes of reinforcement and facilitating the attachment of components supporting and controlling door 20.

As seen in FIGS. 1 and 2, various patterns of decorative components are attached to the outer surfaces of the panels 21. For example, in FIG. 1 the door 20 has decorative components arranged in a "carriage house" design and in FIG. 2 the door 20 has decorative components arranged in a "modified carriage house" design. Each of these designs has horizontal decorative components 31, vertical decorative components 32, and diagonal decorative components 33 arranged in a specified pattern.

As seen in FIG. 5, the panels 21 are provided with a pinch resistant panel-to-panel interface, generally indicated by the numeral 41. The upper extremity of panel 21B is provided with a top edge profile 42 and the lower extremity of panel 21A is provided with a bottom edge profile 43. The top edge profile 42 and bottom edge profile 43 have projecting fingers 44 and 45, respectively, extending along the longitudinal length of panels 21. The projecting fingers 44 and 45 are contoured to form the pinch resistant panel-to-panel interface 41. For example, as the door 20 is articulated between the open and closed positions, the proximity of the projecting fingers 44 and 45 in relation to each other prevents objects or a user's fingers from being inserted and possibly pinched between the edge profiles 42 and 43.

The horizontal decorative components 31 and vertical decorative components 32 are provided with pinch resistant properties and/or are attached in such a manner so as to preserve the pinch resistant feature embodied in the panels 21 discussed above. As seen in FIGS. 1 and 2, the horizontal components 31 abut one another along the interface between panel 21A and panel 21B. Furthermore, one set of vertical components 32 extend in a vertically upward direction and another set of vertical components 32 extend in a vertically downward direction from the horizontal components 31 arranged along the interface between panel 21A and panel 21B. Other panel interfaces may have only vertical decorative components 32 and/or diagonal decorative components 33. Since diagonal decorative components may be configured like the vertical decorative components 32, in the context of this application, the term "vertical decorative components 32" shall encompass both.

The horizontal components 31 and vertical components 32 can be constructed from extruded polymers or metals, or from various roll-formed materials. Both the horizontal components 31 and vertical components 32 are configured to be attached to the panels 21 in such a manner to preserve the pinch resistant features embodied in the panels 21 discussed above. For example, the horizontal components 31 and vertical components 32 are provided with T-shaped channels 51 and channels 52, respectively, allowing these components to be slidably attached to panels 21 by fasteners. The channels 51 and 52 extend along the longitudinal length of the horizontal components 31 and vertical components 32, respectively, to receive fasteners.

Figure 3:
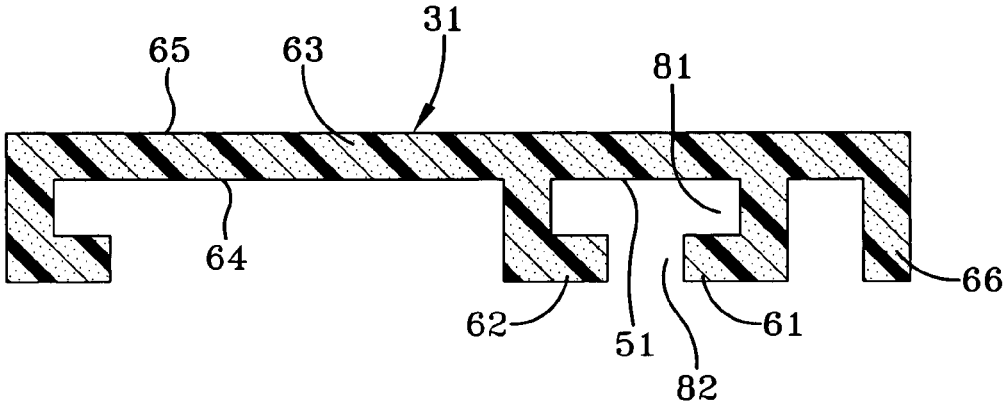
FIG. 3 is a cross-sectional view of a horizontal decorative component taken substantially along line 3—3 of FIG. 1 or 2.

As seen in FIGS. 3 and 5, the channel 51 is disposed in offset relation to the horizontal axis of the cross-section of the horizontal component 31. The channel 51 is formed by opposed L-shaped legs 61 and 62. The horizontal component 31 has a connecting leg 63 with an inner surface 64 and an outer surface 65. The outer surface 65 can be provided with various textures depending on the application. Furthermore, the opposed L-shaped legs 61 and 62 are disposed on the inner surface 64 adjacent leg 66. Furthermore, leg 66 along with L-shaped leg 67 extend perpendicularly from the distal ends of connecting leg 63. The leg 66 abuts the interface between panels 21A and 21B, and, along with L-shaped leg 67 and opposed L-shaped legs 61 and 62, interfaces with outer surface 22.

Figure 4:
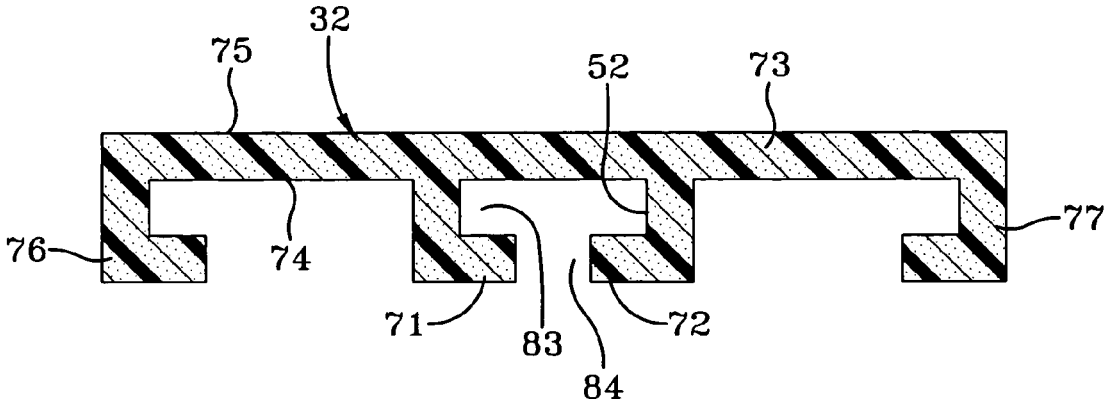
FIG. 4 is a cross-sectional view of a vertical decorative component taken substantially along line 4—4 of FIG. 1 or 2.

With reference to FIG. 4, the channel 52 may be substantially symmetrically disposed about the vertical axis of the cross-section of the vertical component 32. The channel 52 is formed by opposed L-shaped legs 71 and 72 joined to connecting leg 73. Like the horizontal component 31, the vertical component has an inner surface 74 and an outer surface 75. Again, the outer surface 75 can be provided with various textures depending on the application. The opposed L-shaped legs 71 and 72 are joined to the inner surface 74, and are disposed between opposed L-shaped legs 76 and 77 that are joined to the distal ends of connecting leg 73.

As discussed above, the T-shaped channel 51 is formed by opposed L-shaped legs 61 and 62, and the T-shaped channel 52 is formed by opposed L-shaped legs 71 and 72. Furthermore, the horizontal components 31 and vertical components 32 are slidably attached to the panels 21 by fasteners that can be introduced into the T-shaped channels 51 and 52. The T-shaped channels 51 and 52 are composed of segments 81, 83 and perpendicular segments 82, 84, respectively.

As seen in FIG. 5, the fasteners are bolts 91 with heads 92 and shafts 93. The panels 21 have holes 94 extending from the outer surface 22 to the inner surface 23 of the panels 21 for receiving the shafts 93 of bolts 91. The holes 94 are arranged on the panels 21 in patterns that mirror the carriage house and modified carriage house designs discussed above. Furthermore, the T-shaped channels 51 and 52 are configured to selectively retainingly receive the heads 92 and shafts 93.

Figure 6:
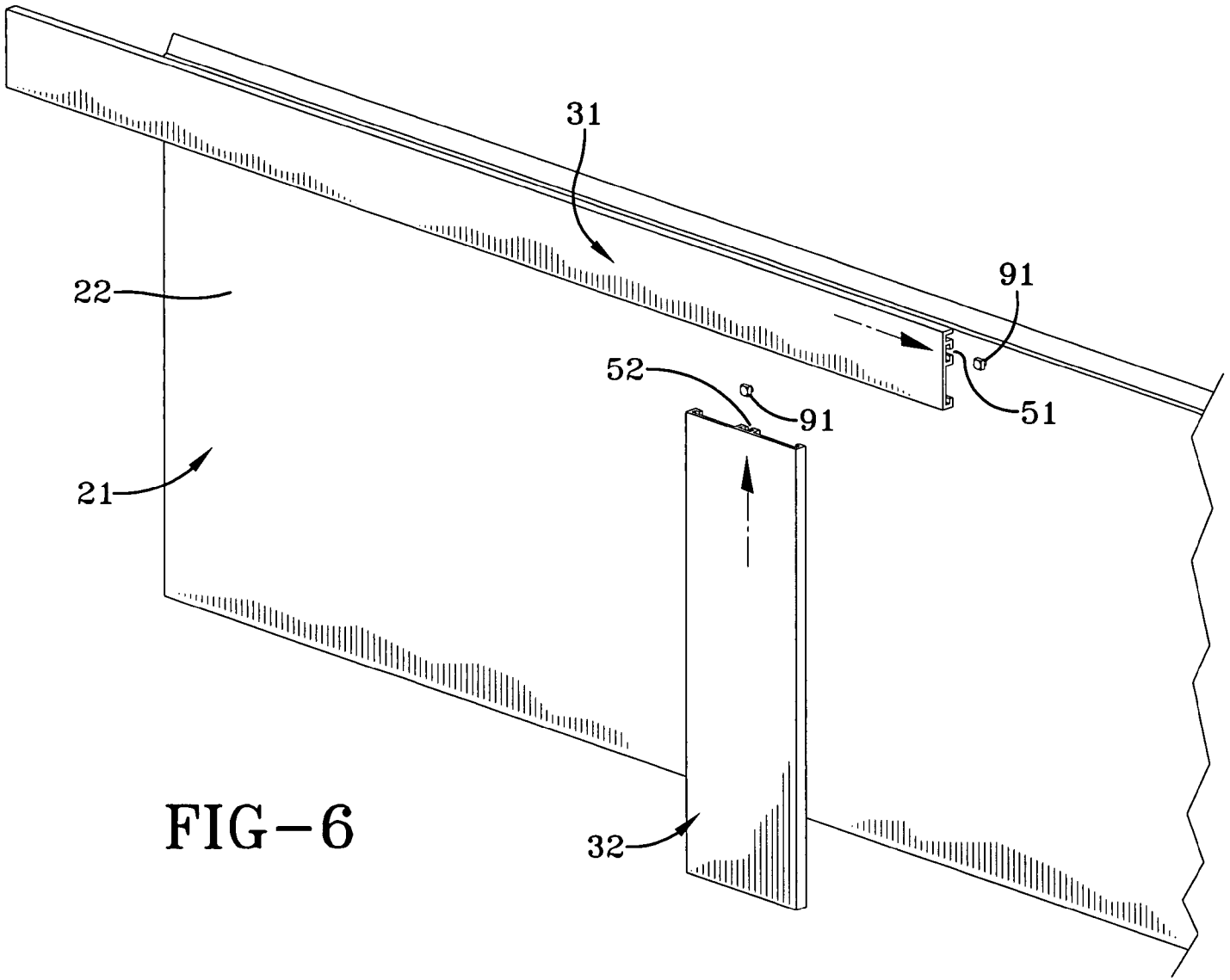
FIG. 6 is an exploded fragmentary perspective view of the horizontal and vertical components during positioning on the panels.

As seen in FIG. 6, the heads 92 and shafts 93 can be introduced into the T-shaped channels 51 and 52. For example, the segments 81, 83 accommodate the heads 92 and the segments 82, 84 accommodate the shafts 93. Once the bolts 91 are introduced into the T-shaped channels 51 and 52, the horizontal components 31 and vertical components 32 are slid into their appropriate positions on the panels 21.

The shafts 93 of bolts 91 must be long enough to traverse the length of the segments 82, 84, and the thickness of the panel 21, as well as provide enough clearance on the inner surface 23 to accommodate nuts 95. Furthermore, once the bolts 91 are located in the T-shaped channels 51 and 52, nuts 95 are screwed onto the bolts 91 to secure the interface between the panels 21 and the horizontal and vertical components 31 and 32.

Figure 7:
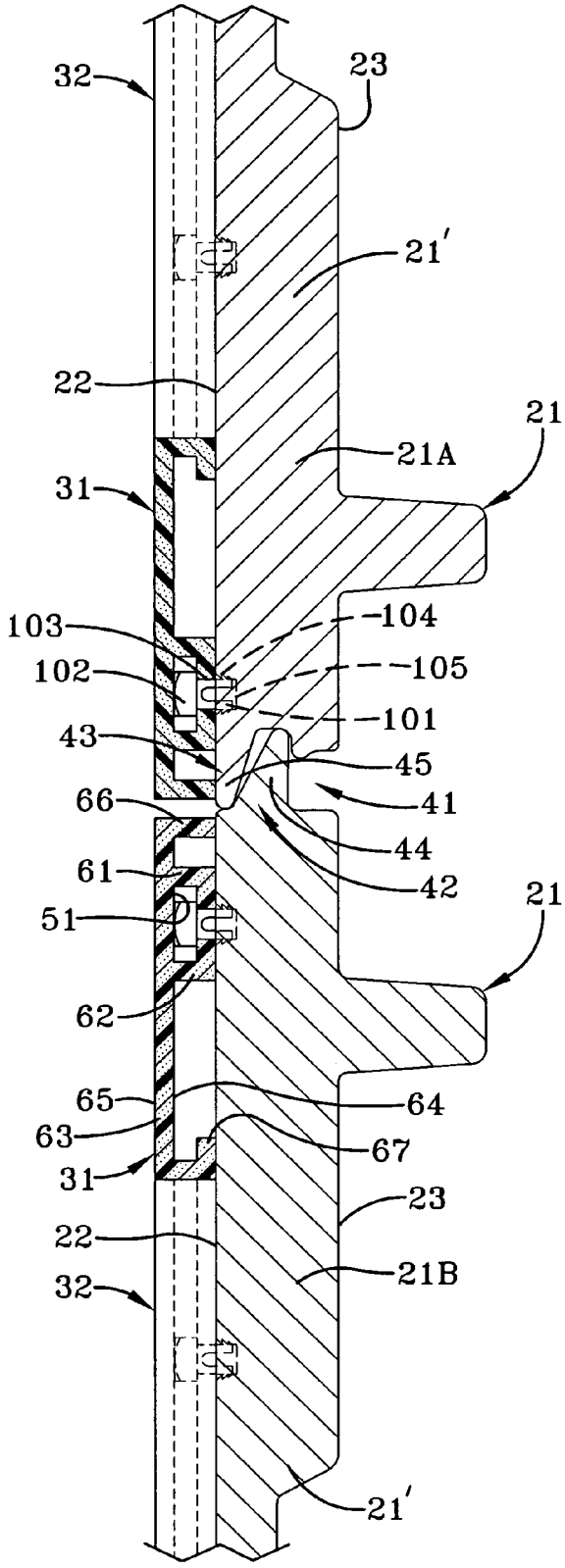
FIG. 7 is a cross-sectional view similar to FIG. 5 showing the use of alternate attachment elements.

In addition, the horizontal components 31 and vertical components 32 can be attached to the panels 21 by a variety of different fasteners provided the fasteners have heads for communicating with the segments 81, 83 and shafts for communicating with the segments 82, 84. For example, as seen in FIG. 7, the horizontal components 31 and vertical components 32 can be slidably attached to the panels via plastic fasteners 101. Plastic fasteners 101 have heads 102, shafts 103, and threads or wings 104. The plastic fasteners 101 do not require holes extending from the outer surface 22 to the inner surface 23 of the panels 21. Instead, the panels 21 can be provided with dimples 105, and the threads or wings 104 can be inserted therein. Like the holes 94, the dimples 105 are arranged in patterns mirroring the carriage house and modified carriage house designs. Furthermore, as with the bolts 91 discussed above, the heads 102 and shafts 103 of plastic fasteners 101 can be inserted into segments 81, 83 and segments 82, 84 of T-shaped channels 51, 52, and the horizontal components 31 and vertical components 32 can be slid into their appropriate positions on the panels 21.

Once properly positioned on the panels 21, the horizontal and vertical components 31 and 32 effectively preserve the pinch resistance embodied in the panels 21. For example, if objects or a user's finger are caught between the horizontal components 31 abutting one another along the interface between panels 21A and 21B as the sectional door 20 opens or closes, then, because the horizontal components are formed of flexible materials, the horizontal components 31 can effectively deform around the objects or the user's fingers. Furthermore, because the vertical components 32 are slidably attached to the panels 21 by fasteners positioned in channels 52, the vertical components 32 can slide along the fasteners away from the horizontal components 31 during deformation. As a result, the pressure against the objects or the user's fingers can be effectively relieved. Furthermore, because the vertical panels 32 are slidably attached to the panels 21, they can be repositioned. As such, the horizontal components 31 and vertical components 32 are provided with pinch resistant properties and are attached in a manner to preserve the pinch resistance embodied in the panels 21 discussed above.

Figure 8:
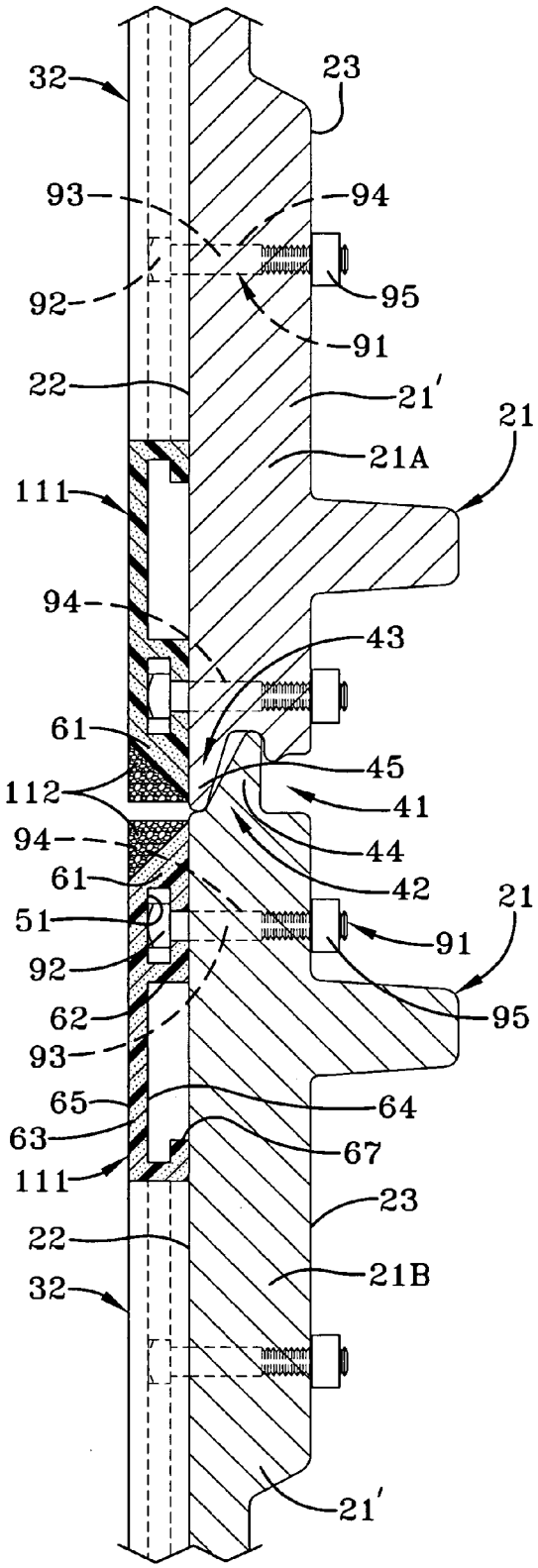
FIG. 8 is a cross-sectional view of the horizontal and vertical components showing the use of foam corner portions on the horizontal components.
Figure 9:
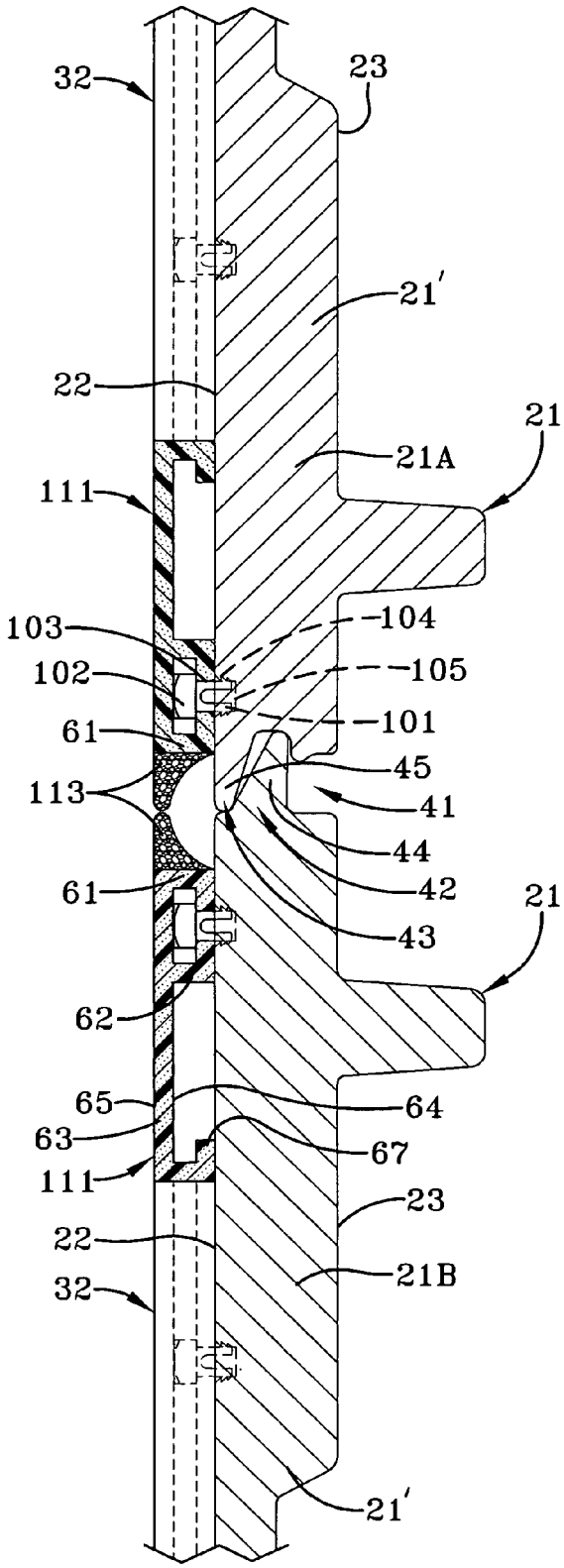
FIG. 9 is a cross-sectional view of the horizontal and vertical components showing the use of foam fingers on the horizontal components.

To further enhance the pinch resistant properties of the horizontal components 31, the legs 66 can be replaced with a deformable or flexible end portion to form horizontal component 111. As seen in FIGS. 8 and 9, the deformable end portions can be an integral deformable corner 112 or a deformable finger 113, respectively. The deformable corner 112 or finger 113 can be co-extruded with the rest of the horizontal component 31. While it is advantageous to form the end portions in the shapes shown in FIGS. 8 and 9, the invention is not intended to be so limited. The end portions can be alternate shapes so long as they provide an acceptable appearance and resist damaging an article caught between the horizontal components 111 at the interface of panel 21A and 21B.

Figure 10:
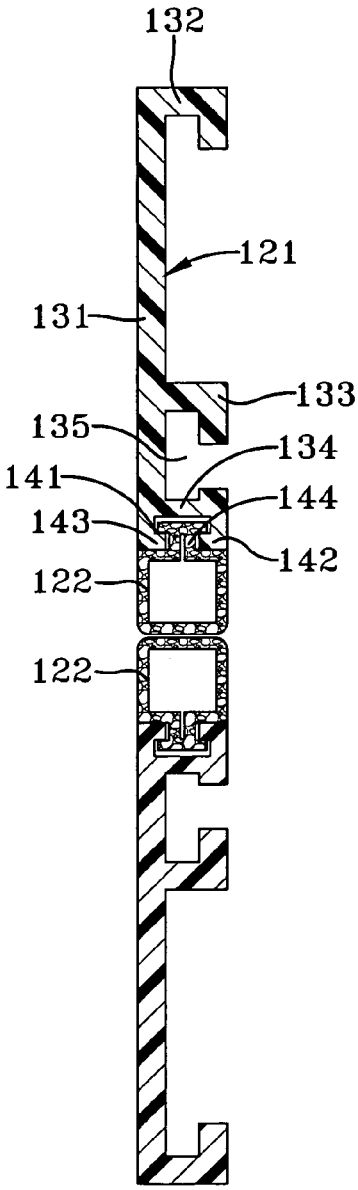
FIG. 10 is a cross-sectional view showing the first embodiment of a removable foam insert.
Figure 11:
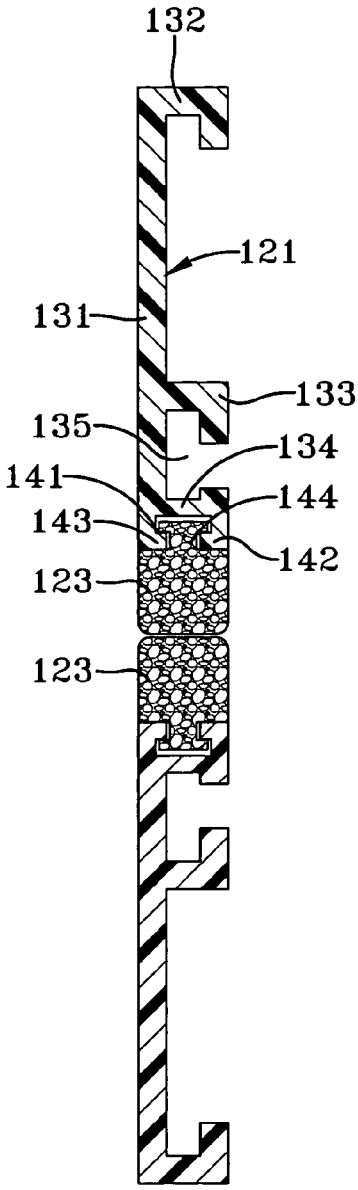
FIG. 11 is a cross-sectional view showing the second embodiment of a removable foam insert.
Figure 12:
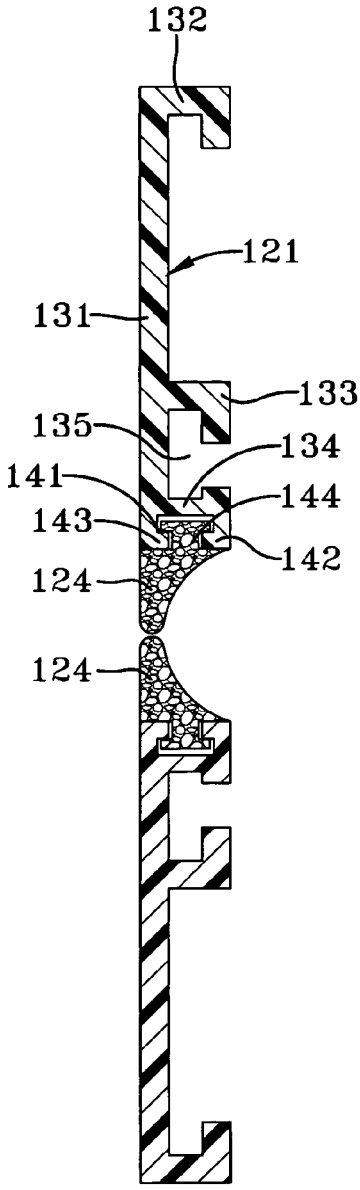
FIG. 12 is a cross-sectional view showing the third embodiment of a removable foam insert.

As seen in FIGS. 10, 11, and 12, it is possible to provide an alternate embodiment using a horizontal component 121 with removable and deformable end portions 122, 123, and 124. The end portions 122 and 123 have a rectangular shape, wherein the end portion 122 is hollow, the end portion 123 is solid and the end portion 124 has a finger-like shape. Furthermore, the horizontal components 121 are provided with a channel 141 for accommodating the end portions 122, 123, and 124. For example, the horizontal components 121 have a connecting leg 131 spacing and joining L-shaped leg 132 and the channel 135 formed by opposed L-shaped legs 133 and 134. The channel 135 is provided to accommodate the head 92 of bolt 91. Furthermore, channel 141 is form by an additional pair of opposed L-shaped legs 142 and 143 that are preferably integral with L-shaped leg 134. Like channel 51 of the horizontal component 31 of the aforementioned embodiment, the channels 135 and 141 extend along the longitudinal length of the horizontal components 121.

Each of the removable and deformable end portions 122, 123, and 124 have key-like flexible inserts 144 which may be made of foam. The inserts 144 are inserted into the channel 141 to removably attach the end portions 122, 123, and 124 to the horizontal components 121. Once properly attached to the horizontal components 121, the end portions 122, 123, and 124 provide an acceptable appearance and resist damaging an article caught between the horizontal components 121 at the interface of panel 21A and 21B. The shapes of the end portions 122, 123, and 124 may take other forms.

In another embodiment of the invention, as seen in FIGS. 13–18, horizontal components 201 and vertical components 231 will ultimately be arranged in the same pattern as the horizontal and vertical components 31 and 32 seen in FIGS. 1 and 2. Again, the horizontal components 201 will abut one another along the interface between the panels 21A and 21B. Furthermore, one set of vertical components 231 will extend in a vertically upward and another set of vertical components 231 will extend in a vertically downward direction from the horizontal components 201 arranged along the interface between panel 21A and panel 21B. Exploded fragmentary views of such a configuration can be seen in FIGS. 16A–16C.

Figure 13:
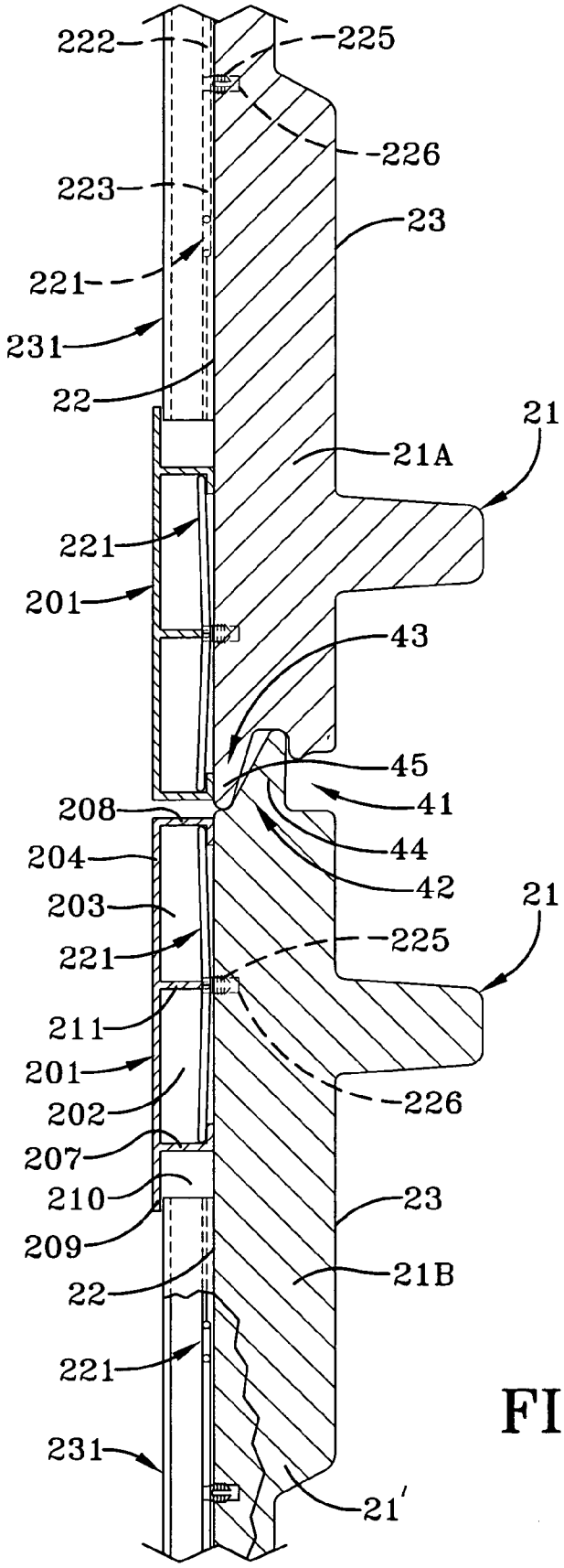
FIG. 13 is a cross-sectional view similar to FIG. 5 showing an alternate embodiment of the horizontal and vertical components attached to the panels.

Like the horizontal and vertical components 31 and 32, the horizontal components 201 and vertical components 231, as seen in FIG. 13, are provided with pinch resistant properties that effectively preserve the pinch resistance embodied in the panels 21. For example, as seen in FIGS. 14 and 15, the horizontal and vertical components 201 and 231 are provided with paired channels 202, 203 and 232, 233, respectively, for accommodating spring clips 221 and their deformable arms 222, 223.

Figure 17A:
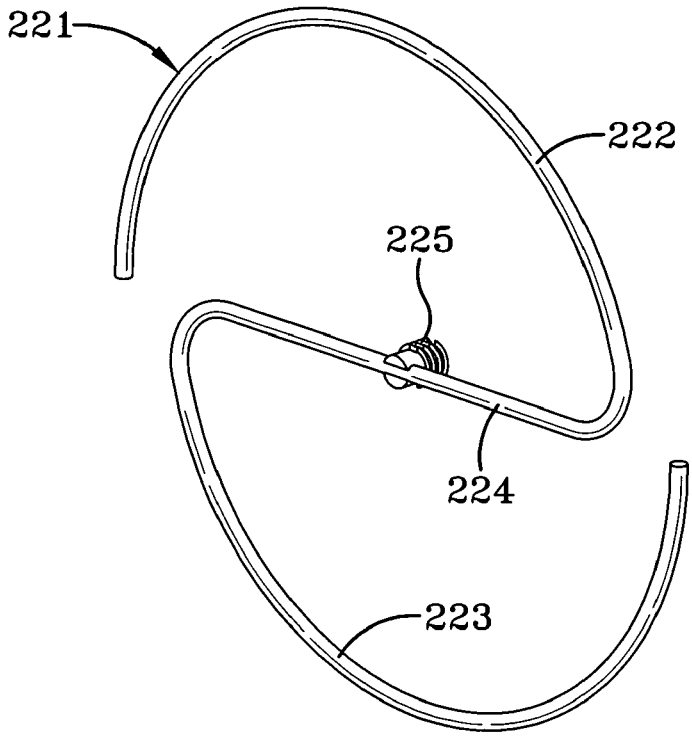
FIG. 17A is a perspective view of a spring clip of the alternate embodiment of FIG. 13.
Figure 17B:
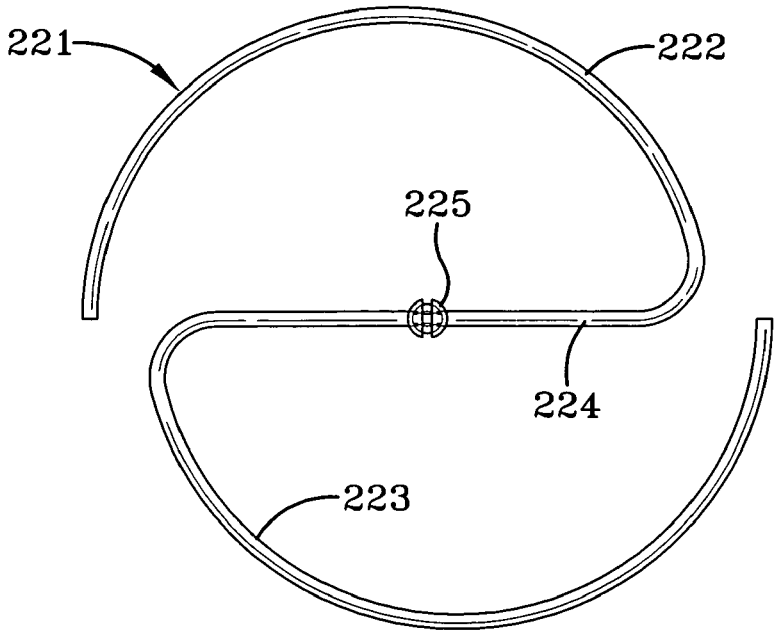
FIG. 17B is a plan view of the spring clip of the alternate embodiment of FIG. 13.

With reference to FIGS. 17A and 17B, the spring clips 221 have base portions 224, and the deformable arms 222, 223 are attached to either ends of the base portions 224. The arms 222, 223 are semi-circular in shape. Furthermore, depending on the orientation of the horizontal and vertical components 201 and 231, the arms 222, 223 alternately extend in clockwise or counter-clockwise directions from the base portions 224. Both of the semicircular shape of the arms 222, 223 and the point of attachment between the arms 222, 223 and the base portions 224 allow the arms 222, 223 to, when necessary, axially deform, while being biased toward remaining in a substantially planar position.

Disposed in the center of the base portions 224 are insertion members 225. The insertion members 225 are inserted in dimples 226 on the outer surfaces 22 of panels 21. The insertion members 225 are adapted to become affixed within the dimples 226. For example, as seen in FIGS. 14, and 15, the insertion members could be provided with threads or wings. Furthermore, like dimples 105, the dimples 226 are arranged in patterns mirroring the carriage house and modified carriage house designs. Therefore, when the spring clips 221 are properly arranged on the panels 21, the horizontal and vertical components 201 and 231 can be slid into their appropriate positions on the panels 21. Each of the channels 202, 203 provided on the horizontal components 201 accommodate one of the arms 222, 223 and each of the channels 232, 233 provided on the vertical components 231 also accommodate one of the arms 222, 223.

Figure 14:
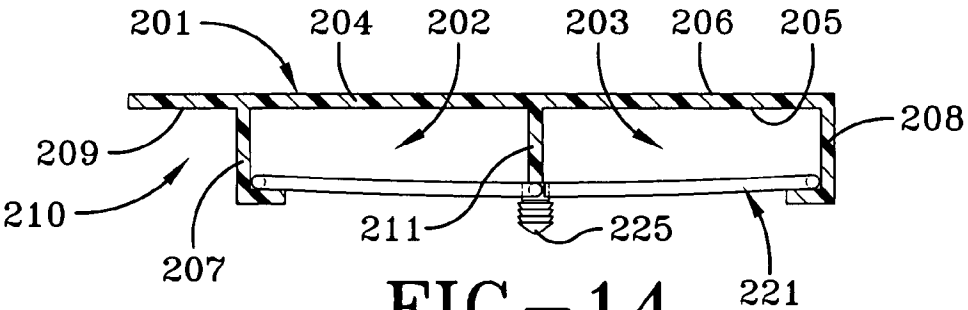
FIG. 14 is a cross-sectional view similar to FIG. 3 showing the horizontal components of the alternate embodiment of FIG. 13.
Figure 15:
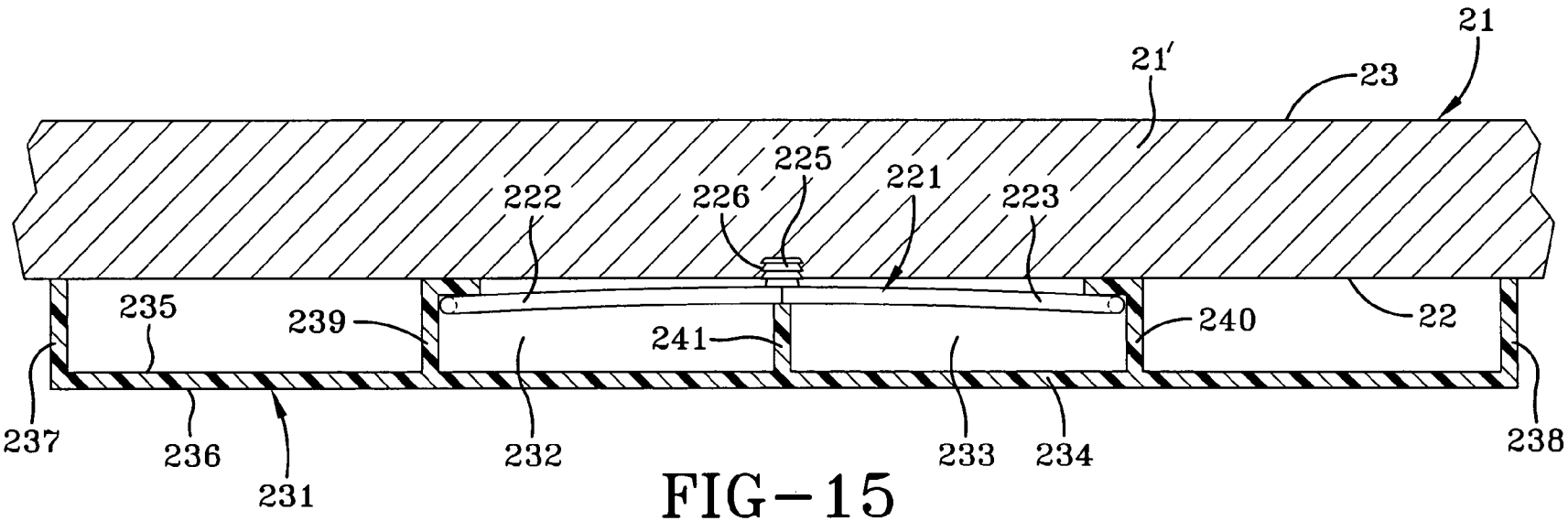
FIG. 15 is a cross-sectional view similar to FIG. 4 showing the vertical components of the alternate embodiment of FIG. 13.
Figure 16A:
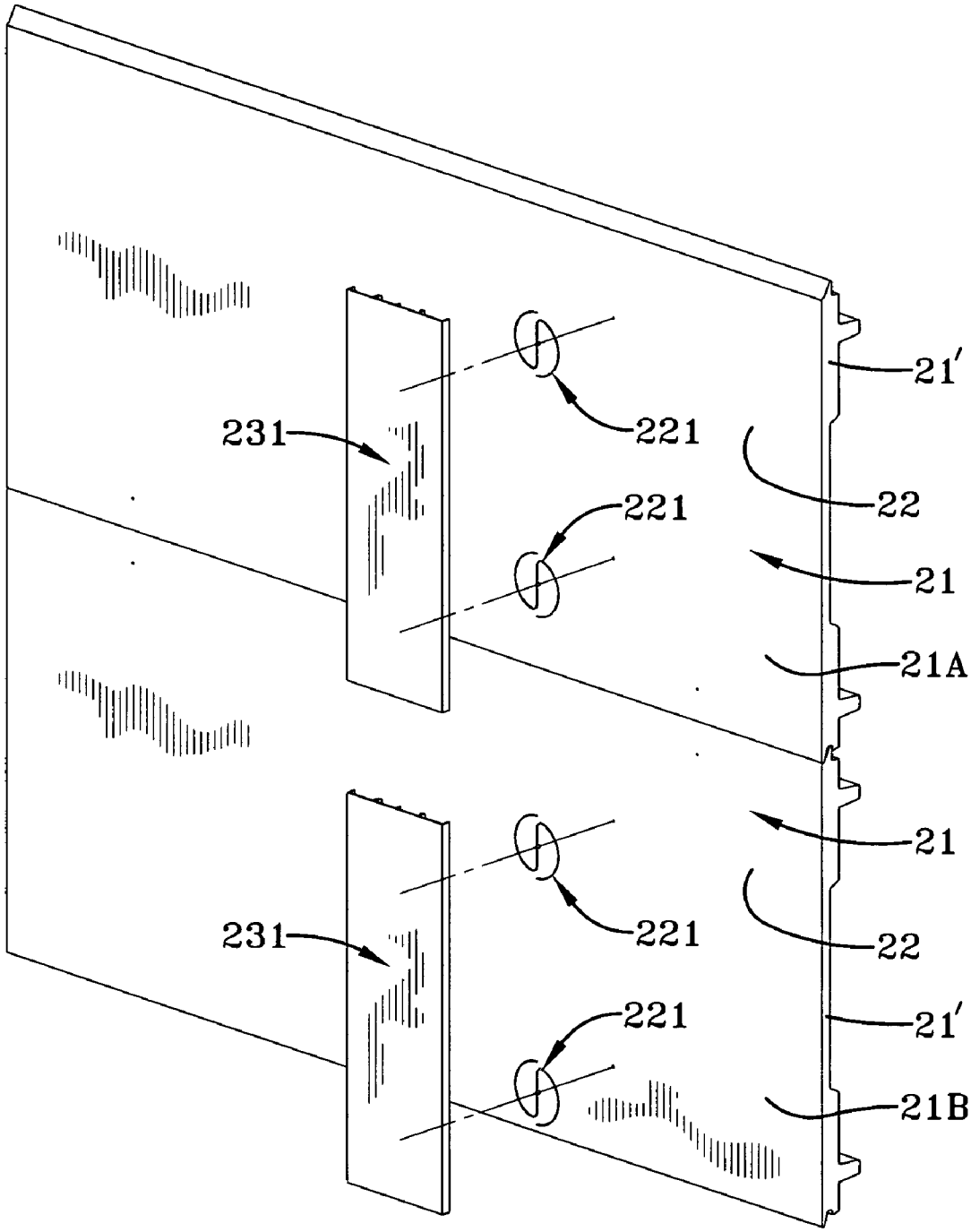
FIG. 16A is an exploded fragmentary perspective view of the vertical components of the alternate embodiment of FIG. 13 during positioning on the panels.
Figure 16B:
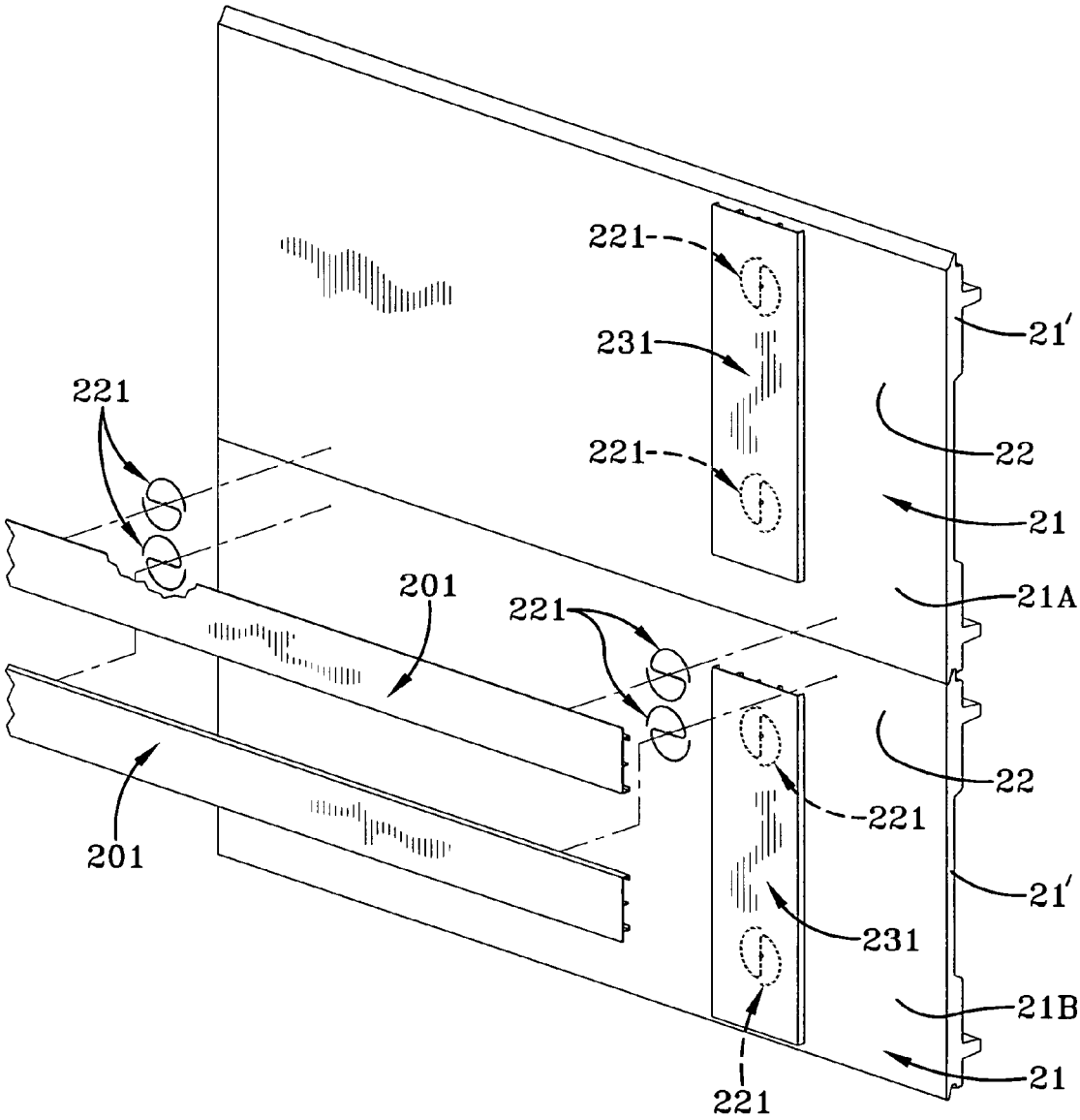
FIG. 16B is an exploded fragmentary perspective view of the horizontal and vertical components of the alternate embodiment of FIG. 13 during positioning on the panels.
Figure 16C:
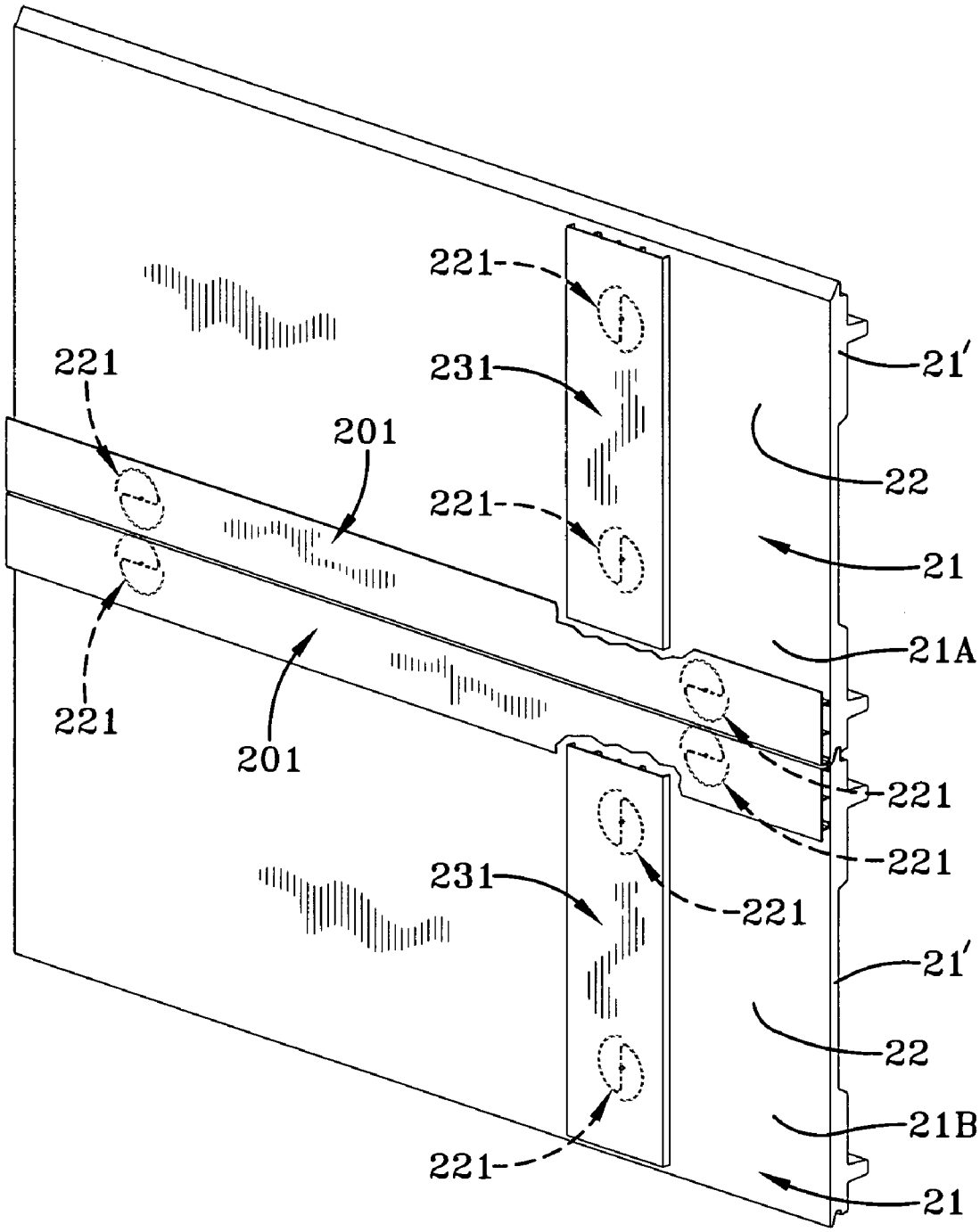
FIG. 16C is a perspective view of the horizontal and vertical components of the alternate embodiment of FIG. 13 as positioned on the panels.

As seen in FIG. 14, the horizontal component 201 has a base portion 204 with an inner surface 205 and an outer surface 206. The outer surface can be provided with various textures depending on the application. On the inner surface 205, the base portion 204 spaces and joins L-shaped legs 207 and 208. The base portion 204 extends beyond the L-shaped leg 207 to create extension portion 209, and the extension portion 209 and opposed L-shaped leg 207 form extension channel 210. The vertical components 231 are ultimately disposed under the extension portion 209 within extension channel 210. For example, the extension channel 210 allows the extension portion 209 of horizontal component 201 to in effect slide over the vertical component 231 while, at the same time, maintain the appearance of the designs discussed above. In other words, the extension portion 209 and the extension channel 210 ultimately allow the horizontal component 201 to move relative to the vertical component 231, and eliminate any gaps between those components that would normally be necessary to permit such movement. In addition, disposed between the L-shaped legs 207 and 208 is a dividing member 211. The channel 202 is formed between the L-shaped leg 207 and dividing member 209 and the channel 203 is formed between the L-shaped leg 208 and the dividing member 209.

As seen in FIG. 15, the vertical component 231 has a base portion 234. The base portion has an inner surface 235 and an outer surface 236. Like the outer surface 206 of the horizontal component 201, the outer surface 236 can be provided with various textures depending on the application. On the inner surface 235, the base portion 234 spaces and joins support legs 237, 238 and L-shaped legs 239, 240. The support legs 237, 238 and L-shaped legs 239, 240 may be symmetrically disposed about a dividing member 241. Additionally, the channel 232 is formed between L-shaped leg 239 and dividing member 241 and the channel 233 is formed between the L-shaped leg 240 and the dividing member 241.

The arms 222 and 223 of the spring clips 221 can be introduced into the channels 202, 203 of the horizontal components 201 and the channels 232, 233 of vertical components 231 to engage L-shaped legs 207, 208 and 239, 240. Such engagement maintains the engagement between the horizontal and vertical components 201 and 231, and the panels 21. In fact, the spring clips 221 effectively clamp the horizontal and vertical components 201 and 231 to the panels because the arms 222 and 223 are biased toward remaining in a substantially planar position and because the width of the channels 202, 203 and 232, 233 is less than the radii of the arms 222 and 223. As a result, clamping action is generated by the axial deformation of the arms 222 and 223 away from their ordinarily planar position.

As seen in FIGS. 14 and 15, the dividing members 211 and 241 maintain the connection of the spring clips 221 to the panels 21. In fact, the dividing members 211 and 241 are used, in part, to prevent the insertion members 225 from exiting the dimples 226, and to structurally reinforce the horizontal and vertical components 201 and 231.

Figure 18:
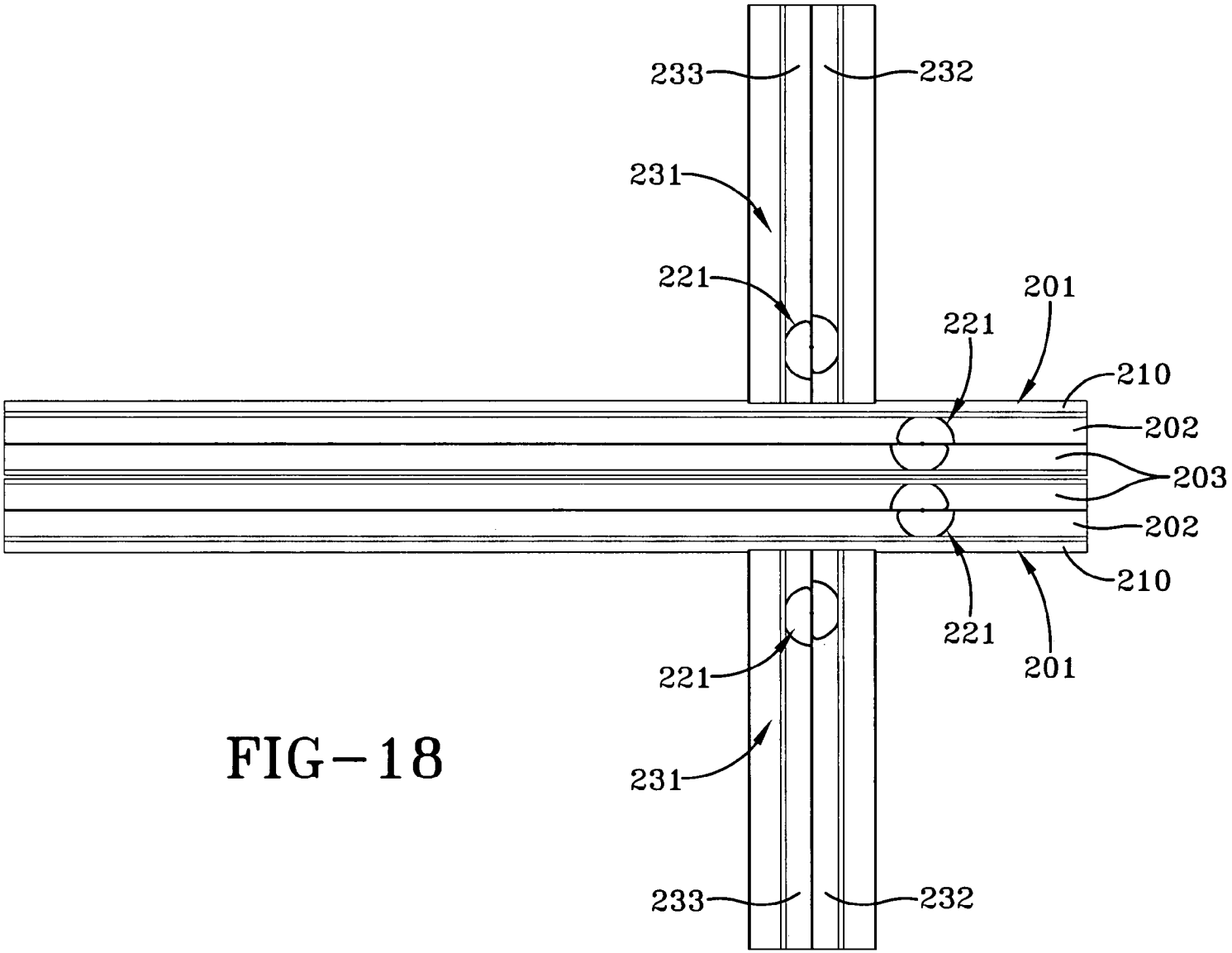
FIG. 18 is a plan view of the inner side of the horizontal and vertical components of the alternate embodiment of FIG. 13.

As seen in FIG. 18, after the horizontal and vertical components 201 and 231 are introduced into the channels 202, 203 and 232, 233, they can be slid into their appropriate positions on the panels 21. As the horizontal and vertical components 201 and 231 are slid into their appropriate positions, the vertical component 231 can be slid underneath the extension portion 209 of the horizontal component 201. The vertical component 231 fits underneath the extension portion 209 because the L-shaped legs 207, 208 of the horizontal components 201 are longer than the L-shaped legs 237, 238 and legs 239, 240 of the vertical components 231. As such, the extension portion 209 is adapted to overlap the vertical component 231. As will be discussed below, such an overlap permits movement of the horizontal component 201 according to the deformation of the spring clips 221.

Once properly positioned on the panels 21, the horizontal and vertical components 201 and 231 in combination with the spring clips 221 effectively preserve the pinch resistance embodied in the panels 21. For example, if objects or a user's finger are caught between the horizontal components 201 abutting one another along the interface between panel 21A and 21B as the sectional door 20 opens and closes, then pressure on the horizontal component will cause axial deformation of the arms 222 and 223 of the spring clips 221. In fact, the arm closest to the interface between the panels 21A and 21B will be compressed and the arm farthest from the interface will be elongated. Such compression and elongation will allow the horizontal components 201 to move relative to the panels 21, and away from the interface of the panels 21A and 21B thus relieving any pressure on the objects or user's fingers. Furthermore, the overlap of the extension portion 209 over the vertical component 231 facilitates such movement by providing the extension channel 210 which provides clearance to allow the horizontal component 201 to move relative to the vertical component 231. In fact, even if the clearance provided is exhausted, and the horizontal and vertical components 201 and 231 directly abut one another, the vertical component 231 can slide along the spring clips 221 to relieve any remaining pressure on the aforementioned objects or user's fingers. Such additional movement is limited by the compression and elongation of the arms 222 and 223 of the spring clips 221 supporting the horizontal components 201.

After the pressure has been relieved, and the objects or the user's fingers have been removed from between the horizontal components 201 at the interface of the panels 21A and 21B, the spring clips 221 allow for repositioning of the horizontal and vertical components 201 and 231. For example, the spring-like action of the arms 222 and 223 will cause the horizontal components 201 to return to their proper position, and, if necessary, also adjust the vertical components 231 accordingly. As a result, the horizontal and vertical components 201 and 231 in combination with the spring clips 221 effectively maintain the pinch resistance and appearance embodied in the panels 21.

In another embodiment of the invention seen in FIGS. 19–28, horizontal decorative components 301 and vertical decorative components 331 are arranged on a sectional door, generally indicated by the numeral 320, in a "vertical line" pattern. It will be appreciated that the horizontal decorative components 301 and the vertical decorative components 331 can, along with diagonal decorative components constructed in a similar manner, be arranged in the patterns depicted in FIGS. 1 and 2, or otherwise. However, for exemplary purposes, the pattern depicted in FIG. 19 will be hereinafter described.

The sectional door 320 is composed of a plurality of panels 321 (including an upper panel 321A, an upper intermediate panel 321B, a lower intermediate panel 321C, and a lower panel 321D), and is configured for articulated movement between open and closed positions, as is well known in the art. The panels have a body portions 321' with outer surfaces 322 and inner surfaces 323 (FIGS. 25–28).

Figure 19:
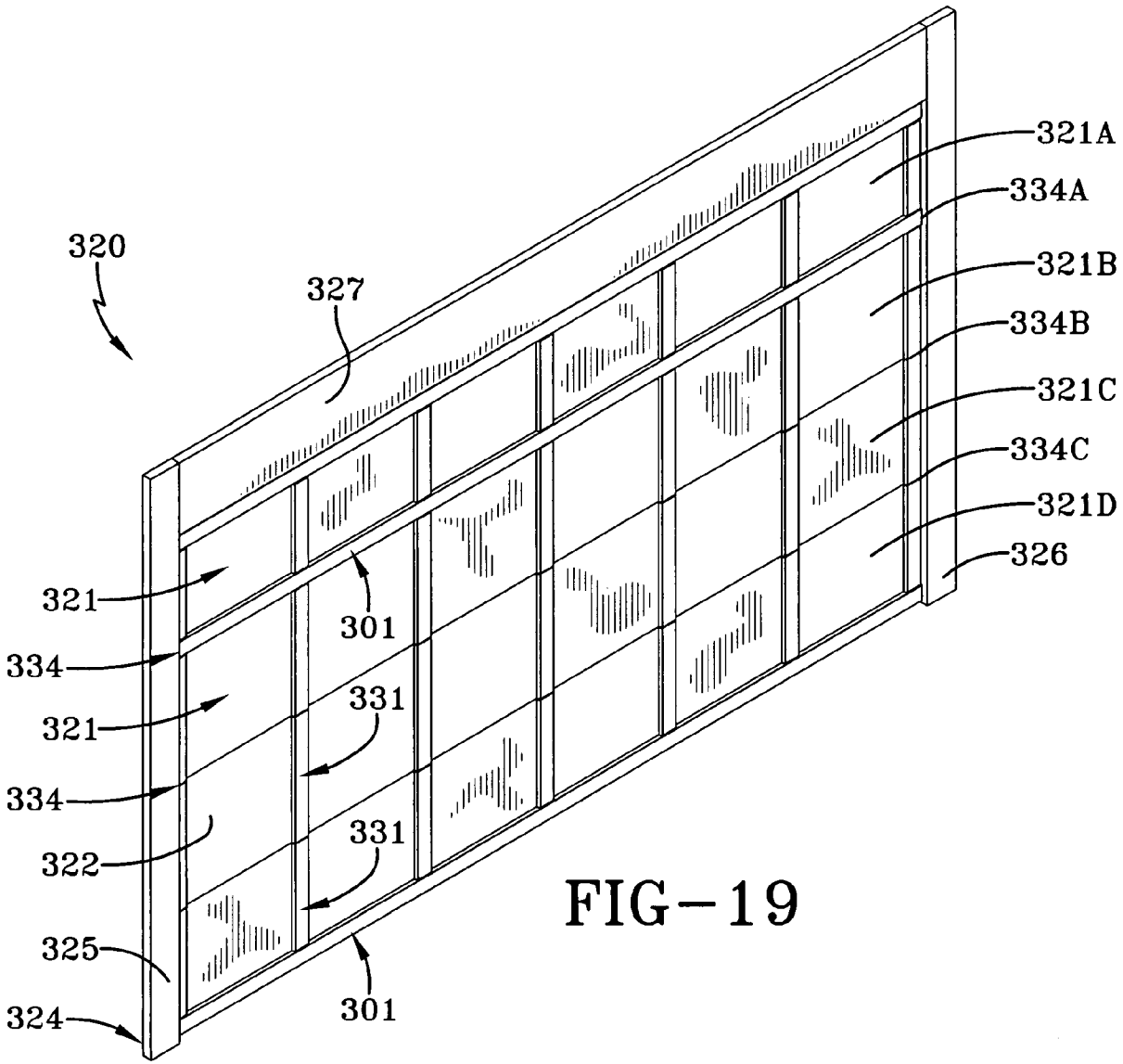
FIG. 19 is a perspective view of an alternate embodiment of decorative components arranged in a "vertical line" pattern on a sectional door.
Figure 21:
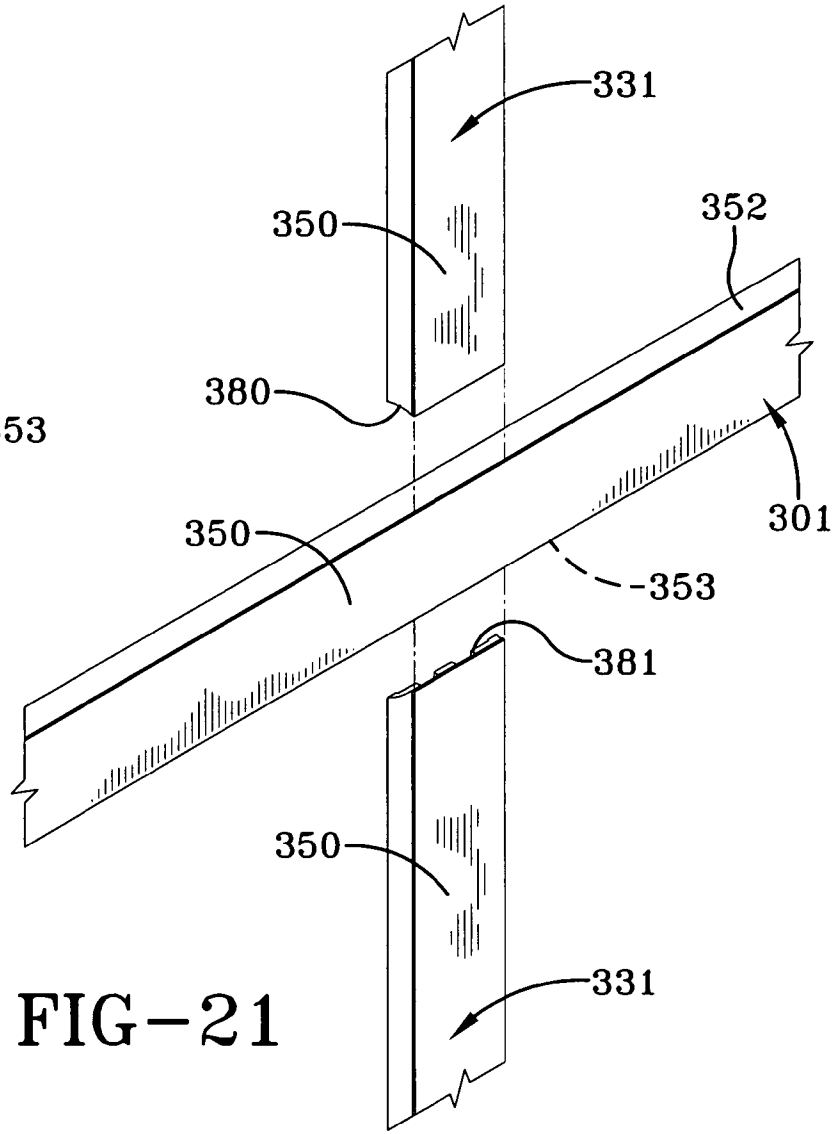
FIG. 21 is an exploded fragmentary perspective view of the two vertical decorative components and horizontal decorative component of FIG. 20.

With reference to FIG. 19, the opening in which the sectional door 320 is positioned to articulate between open and closed positions in conventional fashion is defined by a frame, generally indicated by the numeral 324. The frame 324 consists of a pair of spaced jambs 325, 326 that are generally parallel and extend vertically upwardly from the floor or ground (not shown). The jambs 325, 326 are spaced and joined at their vertical upper extremity by a header 327 to thereby delineate a generally inverted U-shaped frame 324 around the opening of the sectional door 320. The frame 324 is normally constructed of lumber, as is well known to persons skilled in the art, for purposes of reinforcement and facilitating the attachment of components supporting and controlling the sectional door 320.

As seen in FIG. 19, the panels 321 are provided with a pinch resistant panel-to-panel interfaces, generally indicated by the numeral 334. More specifically, a panel-to-panel interface 334A is formed along the abutment of the upper panel 321A and upper intermediate panel 321B, a panel-to-panel interface 334B is formed along the abutment of the upper intermediate panel 321B and lower intermediate panel 321C, and a panel-to-panel interface 334C is formed along the abutment of the lower intermediate panel 321C and lower panel 321D.

FIGS. 25–28 illustrate the configuration of each of the panel-to-panel interfaces 334 which are identical, the panel-to-panel interface 334B will be used for exemplary purposes. To form the panel-to-panel interface 334B, the lower extremity of panel 321B is provided with a bottom edge profile 336 and the upper extremity of panel 321C is provided with a top edge profile 337. The bottom edge profile 336 and top edge profile 337 have projecting fingers 344 and 345, respectively, extending along the longitudinal length of the panels 321.

As such, the bottom edge profile 336 and top edge profile 337 along with their respective projecting fingers 344 and 345 are provided along each of the panel-to-panel interfaces 334. The contour of the projecting fingers 344 and 345 provide for the pinch resistance of the panel-to-panel interfaces 334. For example, as the sectional door 320 is articulated between the open and closed positions, the proximity of the projecting fingers 344 and 345 in relation to each other prevents objects or a user's fingers from being inserted and possibly pinched between the edge profiles 336 and 337. Although the panel-to-panel interfaces 334, and the pinch resistance embodied therein are preferably utilized for the sectional door 320, other panel-to-panel interfaces, including other pinch resistant configurations, could be employed.

The horizontal decorative components 301 and vertical decorative components 331 are configured to have pinch resistant properties and/or are attached in such a manner so as to avoid providing an additional pinch hazard, and thereby preserve the pinch resistant feature embodied in the panels 321 discussed above. As seen in FIG. 19, horizontal decorative components 301 are provided on the upper and lower extremities of the upper panel 321A, as well as on the lower extremity of the lower panel 321D. The vertical decorative components 331 are arranged to complement the horizontal decorative components 301, and complete a specified design. For example, vertical decorative components 331 are provided between the horizontal decorative components 301 located on the upper panel 321A, are spaced along the upper intermediate panel 321B and lower intermediate panel 321C, and are located above the horizontal decorative component 301 on the lower panel 321D.

Figure 28:
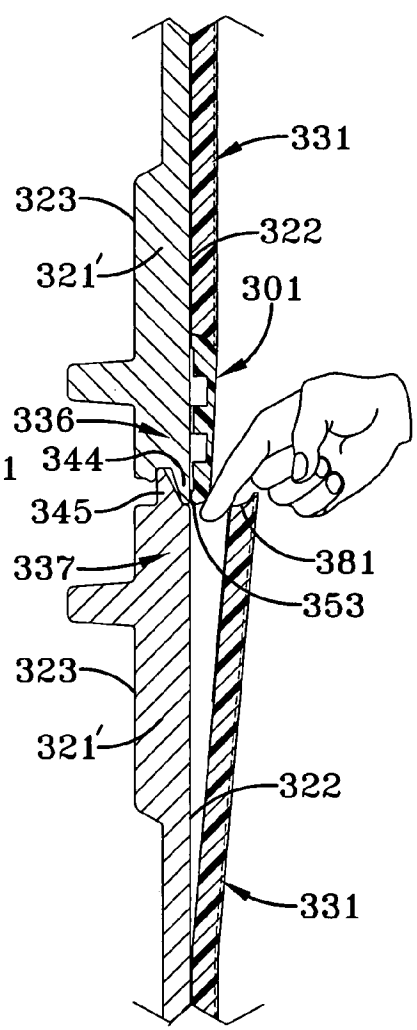
FIG. 28 is a fragmentary cross-sectional view similar to FIG. 27 showing a user's finger inserted between the horizontal decorative component and the vertical decorative component.
Figure 27:
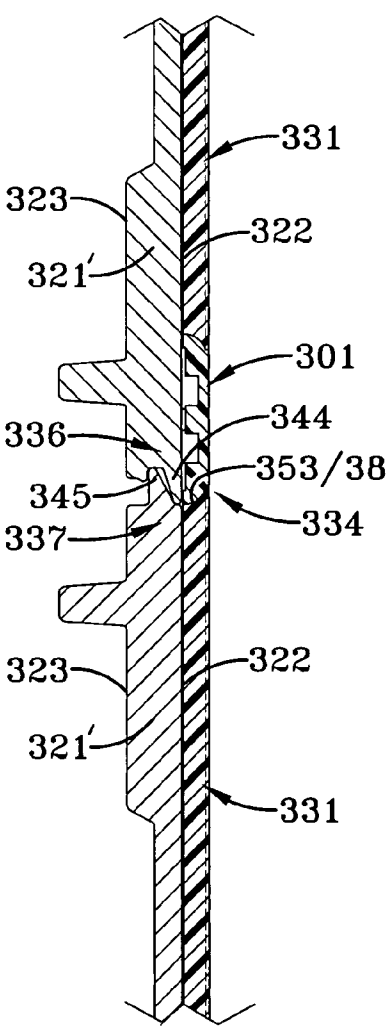
FIG. 27 is a fragmentary cross-sectional view of a horizontal decorative component and a vertical decorative component of FIG. 19 abutting one another along a panel-to-panel interface.
Figure 26:
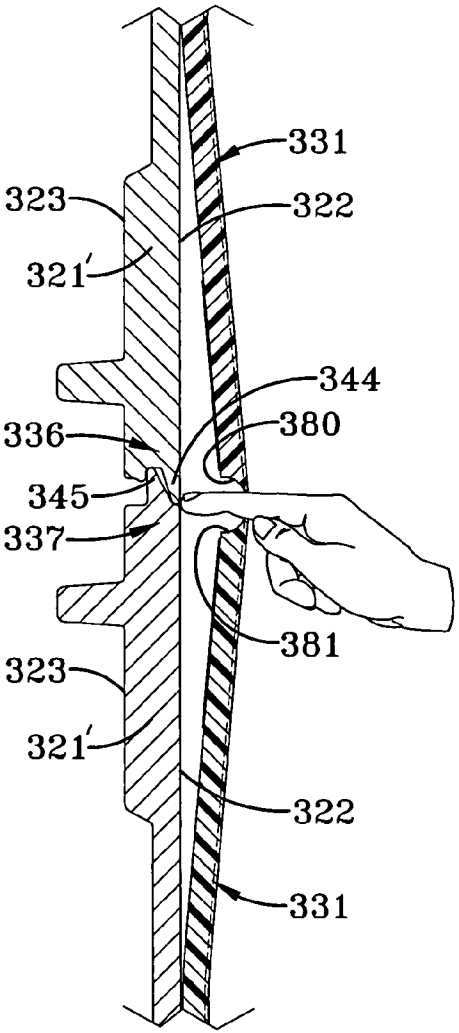
FIG. 26 is a fragmentary cross-sectional view similar to FIG. 25 showing a user's finger inserted between the vertical decorative components.
Figure 25:
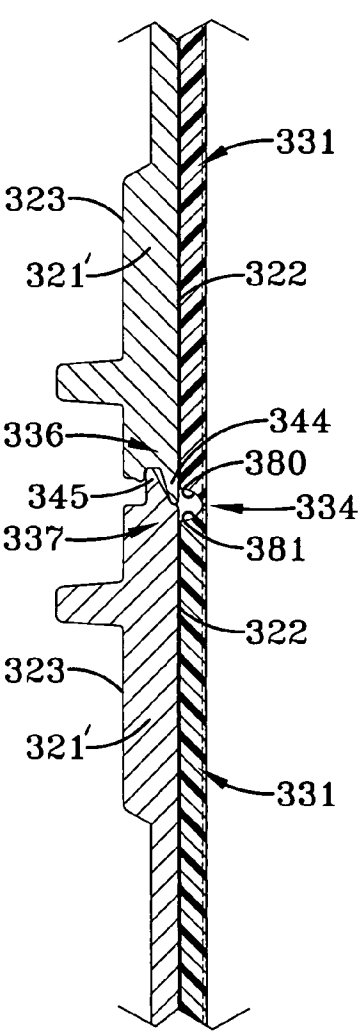
FIG. 25 is a fragmentary cross-sectional view of vertical decorative components of FIG. 19 abutting one another along a panel-to-panel interface.

The pattern shown in FIG. 19 provides for abutting vertical components 331 along panel-to-panel interfaces 334B and 334C (as best illustrated in FIGS. 25 and 26), and horizontal component 301 abutting various vertical decorative components 331 along panel-to-panel interface 334A (as best illustrated in FIGS. 27 and 28).

Figures 22, 23:
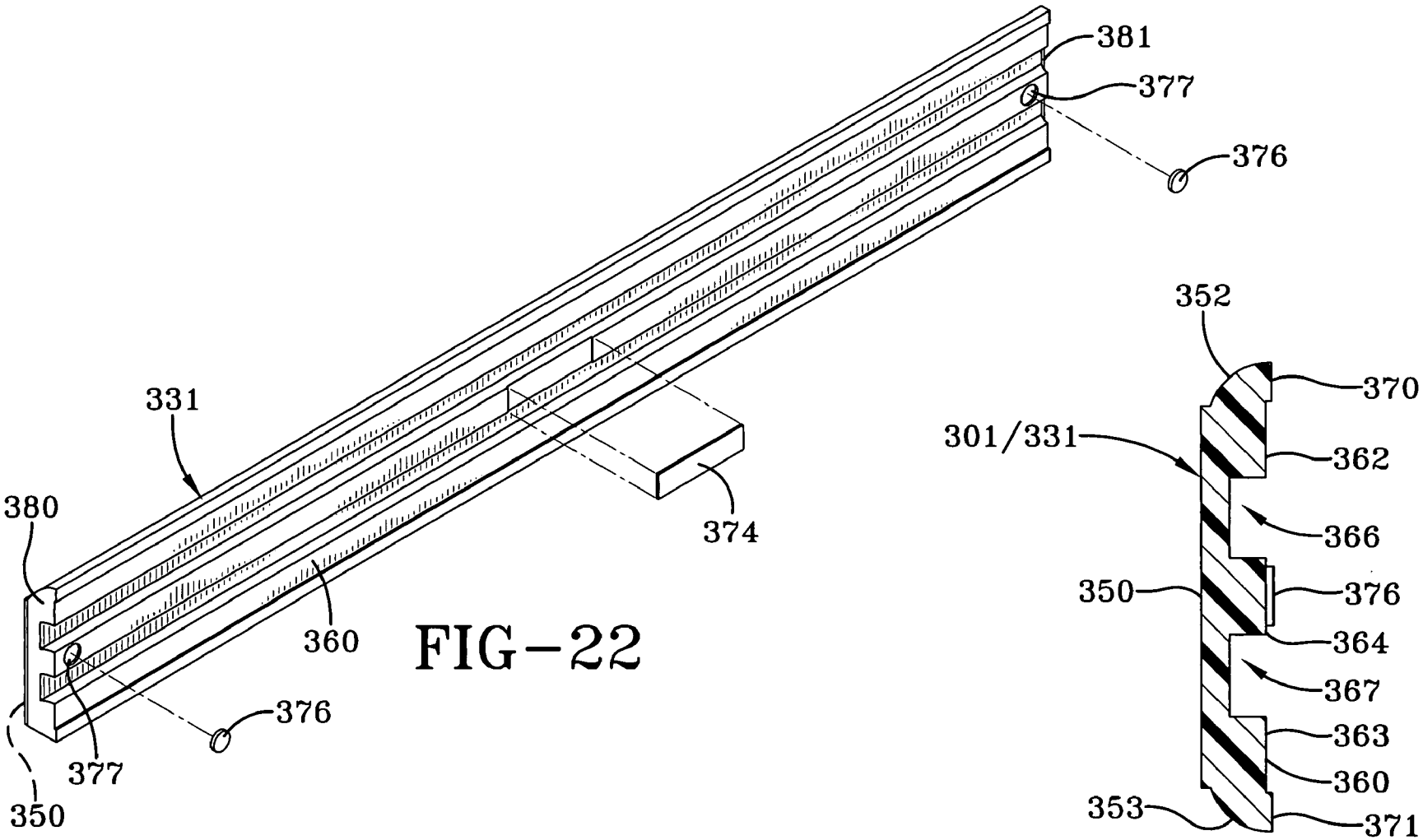
FIG. 22 is an exploded perspective view of a horizontal or vertical decorative component showing the placement of an adhesive pad and magnets on the decorative components of FIG. 14.
FIG. 23 is a side elevational view of a horizontal or vertical decorative component of FIG. 22.

The horizontal decorative components 301 and vertical decorative components 331 are ideally constructed of resiliently deformable extruded polymers, but can also be constructed of ridged or semi-ridged polymers, metals, wood, and fiberglass. As seen in FIG. 23, the horizontal decorative components 301 and vertical decorative components 331 can have the same cross-sectional dimensions. The decorative components 301, 331 each include a front face 350 with beveled longitudinal edges 352, 353 having a quarter round shape. The decorative components 301, 331 each also include a rear face 360 which can be shaped to alternatively increase or decrease the area of contact between the decorative components 301, 331 and the outer surfaces 322 of the panels 321. Furthermore, the rear face 360 can also be shaped to alternatively increase or decrease the amount of materials used to form the decorative components 301, 331.

As seen in FIGS. 22 and 23, the rear face 360 includes outer projections 362, 363 and a middle projection 364. Moreover, a channel 366 is formed between outer projection 362 and middle projection 364, and a channel 367 is formed between outer projection 363 and middle projection 364. The channels 366, 367 eliminate the need for filler material between the various projections, and thereby decrease the weight of the decorative components 301, 331.

The interface between the horizontal decorative components 301 and vertical decorative components 331 and outer surfaces 322 of the panels 321 is provided by contact strips 370, 371. The contact strips 370, 371 are preferably integral with and extend along the longitudinal length of the outer projections 362, 363, respectively. The surfaces of the contact strips 370, 371 ultimately engage the outer surfaces 322 of the panels 321 and are offset from the outer projections 362, 363 and middle projection 364, as seen in FIG. 23. Such an offset provides a gap between the middle projections 364 and the outer surfaces 322 to accommodate placement of an adhesive pad 374 and magnets 376 therebetween. The adhesive pad 374 and magnets 376 are used to attach the decorative components 301, 331 to the panels 321. As seen in FIG. 22, the magnets 376 can be permanently attached to the decorative components 301, 331 by an adhesive, or a detent 377. Furthermore, the adhesive pad 374 may be provided on the decorative components 301, 331 as a tape with adhesive on both surfaces thereof.

Figure 20:
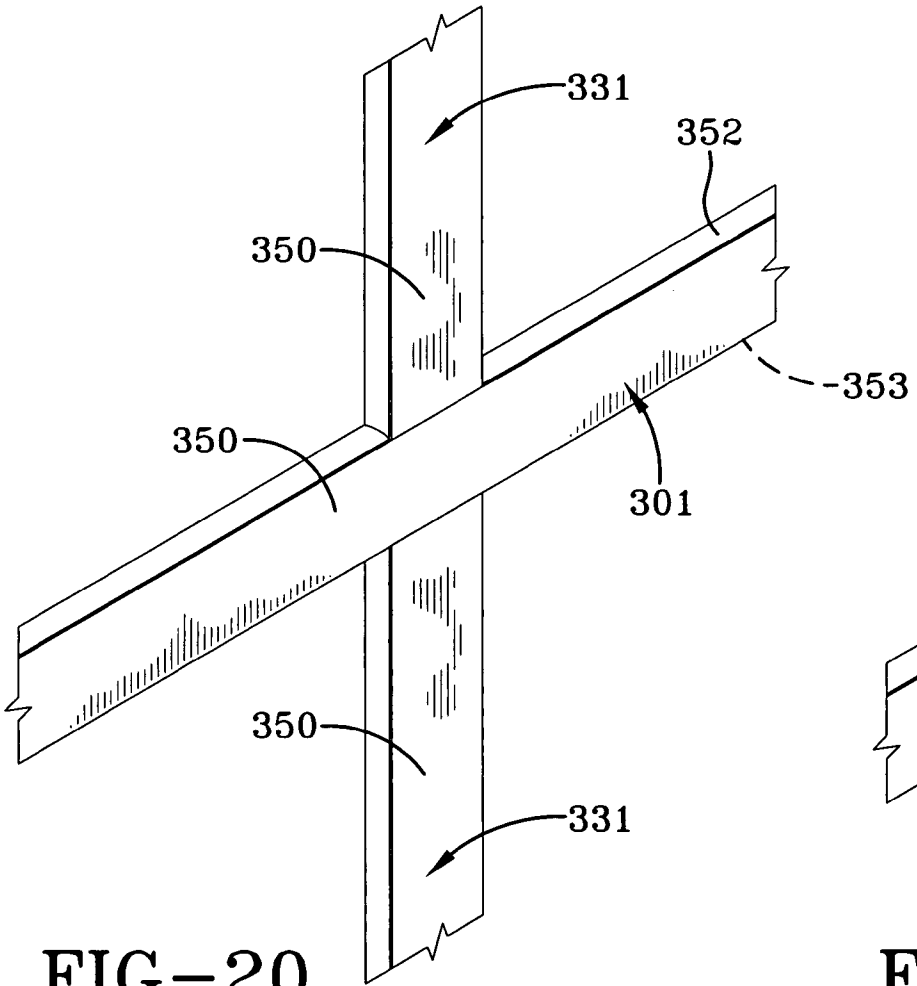
FIG. 20 is a fragmentary perspective view of two vertical decorative components positioned adjacent a horizontal decorative component of the decorative components of FIG. 19.

To provide flat transitions and eliminate any "gapping" between the front faces 350 of horizontal decorative components 301 and vertical decorative components 331 which abut, ends of vertical decorative components 331 are beveled (FIG. 22). More specifically, the ends 380, 381 are coved to match the quarter round shaped of the beveled longitudinal edges 352, 353. As such, when vertical decorative components 301 are provided adjacent horizontal decorative components 331 (FIG. 21), the coved shape of the ends 380, 381 is adapted to accept the beveled longitudinal edges 352, 353 to provide flat transitions between their respective front faces 350 (FIG. 20).

Figure 24:
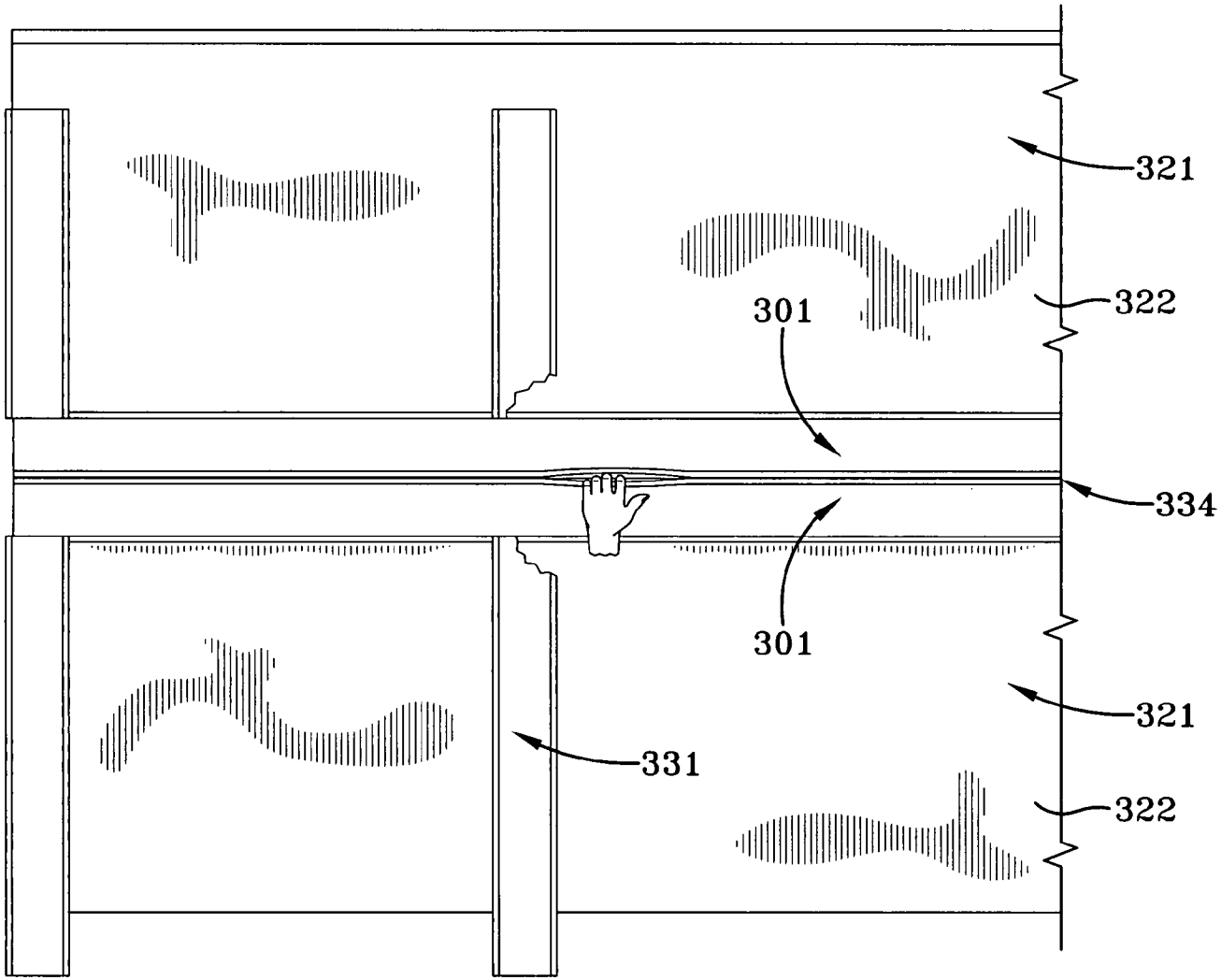
FIG. 24 is a fragmentary plan view of decorative components of FIG. 19 arranged in a modified "vertical line" pattern on a sectional door where two horizontal decorative components abut one another along a panel-to-panel interface.

Moreover, the configuration of the horizontal decorative components 301 and vertical decorative components 331 allows the pinch resistant properties embodied in the panels 321 to be preserved. For example, the decorative components 301, 331 as discussed above, are ideally constructed of resiliently deformable material. Therefore, as seen in FIG. 24, if two horizontal decorative components 301 constructed in such a manner are arranged to abut one another along a panel-to-panel interface 334, and objects or a user's fingers are accidently inserted therebetween as the sectional door 320 is articulating (i.e. closing or opening), the horizontal decorative components 301 will deform. That is, the horizontal decorative components 301 constructed of resiliently deformable materials provide a "soft" interface therebetween, and will deform around objects or a user's fingers to relieve any pressure thereon and thereby preserve the pinch resistant properties embodied in the panels 321. Thereafter, when objects or a user's fingers are removed from between the horizontal components 301, the horizontal components 301 will return to their original shape.

The same holds true for vertical decorative components 331 constructed of resiliently deformable materials abutting one another along a panel-to-panel interface 334. The vertical decorative components 331 will initially deform around objects or a user's fingers inserted therebetween as the sectional door 320 is closing to relieve any pressure thereon. In such a case, the coved shape of the ends 380, 381 enhances the ability of the vertical decorative components 331 to deform due to the presence of objects or a user's fingers along a panel-to-panel interface. The coved shape decreases the amount of material used in forming the ends 380, 381, and, therefore, enhances the "soft" interface between the abutting vertical decorative components by decreasing the amount of force required to deform the ends 380, 381 around objects or a user's fingers. Moreover, the resiliently deformable materials used in forming the vertical decorative components 331 allows the vertical decorative components 331 to return to their original shape. As such, the configuration of the decorative components 301, 331 allows the pinch resistant properties embodied in the panels 321 to be preserved.

Furthermore, the attachment of the horizontal decorative components 301 and vertical decorative components 331 also allows the pinch resistant properties embodied in the panels 321 to be preserved. In fact, even when the decorative components 301, 331 are constructed of ridged polymers, semi-ridged polymers, metals, or fiberglass, and do not provide the "soft" interfaces discussed above, the pinch resistance embodied in the panel-to-panel interfaces 334 can still be achieved.

For example, each of the decorative components 301, 331 is flushly attached to the outer surfaces 322 of the panels 321 using the adhesive pad 374 and magnets 376. The adhesive pad 374 affords a semi-permanent connection with the outer surface 322, whereas the magnets 376 releasably engage the outer surface 322. In this context semi-permanent shall mean permanent during operation of the sectional door 320, but capable of otherwise being repositioned to form a different patten. The outer surface 322 is ideally constructed of steel to afford a magnetic connection with the magnets 376, or, alternatively, a ferrometallic tape may be attached to the panels 321 at mating locations in the instance of panels 321 constructed of wood, plastic, or other non-ferrous material.

The decorative components 301, 331 can easily be rearranged (during manufacture or in the field before and after installation) on the panels 321 using the adhesive pad 374 and magnets 376, and, as discussed below, are easily repositioned thereon. In addition, if modifications are made to the decorative components 301, 331 (such as eliminating the above-discussed offset), glues or other adhesives can be used in place of the adhesive pad 376. Additionally, the magnets 376 can be replaced by manufacturing the decorative components 301, 331 with a slight bow or camber. That is, by slightly biasing the ends of the decorative components 301, 331 inwardly relative to the rear face 360, the need for the magnets 376 can be eliminated. The adhesive pad 376 and slight bow will hold the decorative components 301, 331 in engagement with the outer surface 322 of the panels 321.

As seen in FIGS. 26 and 28, the portion of the vertical decorative components 331 secured using the magnets 376 can be readily released from the outer surface 322. Therefore, if objects or a user's fingers are accidently inserted along a panel-to-panel interface 334, the portion of the decorative components 301, 331 secured by the magnets 376 can be temporarily released to deflect away from the outer surface 322 to avoid acting as a pinch point. As such, the portion of the vertical decorative components 331 secured by the magnets 376 effectively pivots about the portion of the vertical decorative components 331 secured by the adhesive pad 374.

For example, if, as the sectional door 320 is closing, a user's finger is accidently inserted between abutting decorative components 301, 331, such as the abutting vertical components 331 (FIG. 26) or abutting horizontal decorative component 301 and vertical decorative component 331 (FIG. 28), the magnets 376 allow at least one of the abutting vertical decorative components 331 to be released and displaced from the outer surface 322 of the panel 321. As such, the magnets 376 prevent abutting decorative components 301, 331 from serving as pinch points which defeat the pinch resistant properties embodied in the panels 321. Furthermore, the magnets 376 allow the vertical decorative components 331 to be repositioned on the outer surfaces after objects or a user's fingers have been removed.

Moreover, the shape of the ends 380, 381 increases the likelihood of that at least one of the abutting decorative components will be released from the outer surface 322. As discussed above, when the decorative components 301, 331 are constructed of resiliently deformable materials, their coved shape allows the ends 380, 381 to more readily deform around objects or a user's fingers. However, the coved shape also allows objects and a user's fingers to serve as a fulcrum to release the magnets 376. Due to the coved shape of the ends 380, 381, the fulcrum is positioned a distance away from the outer surface 322. The farther the distance of the fulcrum is away from the outer surface 322, the less force required to release the magnets 376. As such, the coved shape of the ends 380, 381 not only decreases the amount of force required to deform the ends 380, 381 depending on the materials used in forming the decorative components 301, 331, but also increases the likelihood that the vertical decorative components 331 will be released from the outer surfaces 322 of the panel 321.

Consequently, the horizontal decorative components 301 and vertical decorative components 331 are configured to have pinch resistant properties and/or are attached in such a manner so as to preserve the pinch resistant feature embodied in the panels 321 discussed above.

Thus, it should be evident that the section door panel and method of attaching decorative components to maintain a pinch resistant panel to panel interface disclosed herein carries out one or more of the objects of the present invention set forth above and otherwise constitutes an advantageous contribution to the art. As will be apparent to persons skilled in the art, modifications can be made to the preferred embodiment's disclosed herein without departing from the spirit of the invention, the scope of the invention herein being limited solely by the scope of the attached claims.

The invention claimed is:

1. A sectional door comprising a plurality of panels joined for moving between open and closed positions of the door and having pinch resistant panel-to-panel interfaces, said panels having a body portion spacing said interfaces, an inner surface and an outer surface of said body portion, and decorative components arranged in a patterned design upon said outer surface of said body portion, said decorative components being positioned on said panels proximate to said panel-to-panel interfaces and having portions that releasably engage said panels to provide a pinch resistant interface between decorative components on adjacent of said panels, wherein said portions that releasably engage said panels are proximate the ends of said decorative components and said decorative components are cambered to normally maintain said ends of said decorative components in engagement with said panels.

2. A sectional door according to claim 1, wherein said decorative components include horizontal decorative components and vertical decorative components.

3. A sectional door according to claim 2, wherein magnets are positioned proximate the ends of said vertical decorative components to releasably attach said portions of said vertical decorative components to said panels, while other portions of said vertical decorative components are semi-permanently attached to said panels.

4. A sectional door according to claim 3, wherein a plurality of said vertical decorative components are placed on adjacent of said panels in abutting relation along said panel-to-panel interfaces.

5. A sectional door according to claim 4, wherein said portions of said vertical decorative components are released from said panels due to the presence of objects or a user's fingers along said panel-to-panel interfaces, said vertical decorative components deflecting about said other portions which are semi-permanently attached to said panels.

6. A sectional door according to claim 5, wherein the ends of said vertical components are coved to provide a fulcrum generated by said presence of objects or a user's fingers a distance away from said outer surfaces.

7. A sectional door according to claim 3, wherein a plurality of said vertical decorative components and at least one of said horizontal decorative components are placed on adjacent of said panels in abutting relation along said panel-to-panel interfaces.

8. A sectional door according to claim 7, wherein said portions of said vertical decorative components are released from said panels due to the presence of objects or a user's fingers along said panel-to-panel interfaces, said vertical decorative panels deflecting about said other portions which are semi-permanently attached to said panels.

9. A sectional door according to claim 8, wherein the ends of said vertical components are coved to provide a fulcrum generated by said presence of objects or a user's fingers a distance away from said outer surfaces.

10. A sectional door according to claim 8, wherein said decorative components are deformable along said panel-to-panel interfaces.

11. A sectional door according to claim 1, wherein said decorative components are attached to the panels substantially medially thereof.

12. A sectional door according to claim 11, wherein said decorative components are attached to the panels medially thereof by an adhesive.

13. A method of constructing a pinch resistant sectional door having a decorative outer surface comprising the steps of, providing a plurality of panels having pinch resistant panel-to-panel interfaces, joining adjacent panels for articulation in moving from a closed vertical position to an open horizontal position, providing decorative components sized to establish a desired decorative pattern on the outer surface of the door, releasably engaging portions of the decorative components to the panels in a manner permitting said portions of the decorative components to deflect away from the panel-to-panel interfaces to provide a pinch resistant interface between decorative components on adjacent of the panels, and cambering the decorative components so that the ends thereof releasably engage said panels.

14. The method of claim 13, wherein the step of releasably engaging portions of the decorative components to the panels includes the step of positioning magnets proximate the ends of the decorative components to releasably attach said portions of the decorative components.

15. The method of claim 13 further comprising, the step of semi-permanently attaching at least another portion of the decorative components to the panels.

16. A sectional door comprising a plurality of panels joined for moving between open and closed positions of the door and having pinch resistant panel-to-panel interfaces, said panels having a body portion spacing said interfaces, an inner surface and an outer surface of said body portion, and decorative components arranged in a patterned design upon said outer surface of said body portion, said decorative components being positioned on said panels proximate to said panel-to-panel interfaces and having releasable portions that releasably engage said panels, said decorative components including horizontal decorative components and vertical decorative components, wherein the ends of said vertical components are coved to provide a fulcrum generated by said presence of objects or a user's fingers a distance away from said outer surfaces to provide a pinch resistant interface between said decorative components on adjacent of said panels.

* * * * *